US009709912B2

(12) United States Patent
Fuwa et al.

(10) Patent No.: US 9,709,912 B2
(45) Date of Patent: Jul. 18, 2017

(54) TONER, AND IMAGE FORMING METHOD, PROCESS CARTRIDGE, AND IMAGE FORMING APPARATUS USING THE TONER

(71) Applicants: Kazuoki Fuwa, Hyogo (JP); Takuya Kadota, Hyogo (JP); Yoshihiro Mikuriya, Hyogo (JP); Tsuyoshi Nozaki, Osaka (JP); Yoshimichi Ishikawa, Hyogo (JP); Yuta Takeuchi, Hyogo (JP); Tomohiro Fukao, Osaka (JP); Tomoharu Miki, Osaka (JP); Takayuki Nakamura, Osaka (JP)

(72) Inventors: Kazuoki Fuwa, Hyogo (JP); Takuya Kadota, Hyogo (JP); Yoshihiro Mikuriya, Hyogo (JP); Tsuyoshi Nozaki, Osaka (JP); Yoshimichi Ishikawa, Hyogo (JP); Yuta Takeuchi, Hyogo (JP); Tomohiro Fukao, Osaka (JP); Tomoharu Miki, Osaka (JP); Takayuki Nakamura, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 51 days.

(21) Appl. No.: 14/042,993

(22) Filed: Oct. 1, 2013

(65) Prior Publication Data

US 2014/0147779 A1 May 29, 2014

(30) Foreign Application Priority Data

Nov. 29, 2012 (JP) ..... 2012-261127

(51) Int. Cl.

| | |
|---|---|
| ***G03G 9/087*** | (2006.01) |
| ***G03G 13/08*** | (2006.01) |
| ***G03G 13/06*** | (2006.01) |

(52) U.S. Cl.

CPC ..... *G03G 9/08797* (2013.01); *G03G 9/08755* (2013.01); *G03G 9/08795* (2013.01); *G03G 13/06* (2013.01); *G03G 13/08* (2013.01)

(58) Field of Classification Search

CPC ..... G03G 9/08797; G03G 9/08795; G03G 9/08755; G03G 13/08

(Continued)

(56) References Cited

U.S. PATENT DOCUMENTS 7,291,436 B2 * 11/2007 Nakamura ..... G03G 9/0821 430/110.2
2005/0214670 A1 * 9/2005 Matsumoto et al. ..... 430/109.4

(Continued)

FOREIGN PATENT DOCUMENTS

JP 2002287426 A * 10/2002
JP 2003-050478 2/2003

(Continued)

OTHER PUBLICATIONS

English language machine translation of JP 2002-287426 (Oct. 2002).*

(Continued)

*Primary Examiner* — Christopher Rodee
(74) *Attorney, Agent, or Firm* — Oblon, McClelland, Maier & Neustadt, L.L.P.

(57) ABSTRACT

A toner is provided. The toner includes a crystalline resin and a non-crystalline resin, and has a thermal property such that when the toner is heated after being firstly heated to 60° C. followed by cooling in differential scanning calorimetry (DSC), the toner has a clear peak specific to melting of the crystalline resin at a temperature T1, and when the toner is heated after being firstly heated to 80° C. followed by cooling in the differential scanning calorimetry (DSC), the toner does not have a clear peak specific to melting of the (Continued)

crystalline resin at a temperature not higher than the temperature T1.

4 Claims, 5 Drawing Sheets

(58) Field of Classification Search
USPC ..... 430/109.4, 111.4, 110.3
See application file for complete search history.

(56) References Cited

U.S. PATENT DOCUMENTS

| | | | | |
|---|---|---|---|---|
| 2006/0204880 | A1* | 9/2006 | Mizutani et al. | 430/109.4 |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2006/0292474 | A1 | 12/2006 | Mikuriya et al. | |
| 2007/0026335 | A1 | 2/2007 | Yamamoto et al. | |
| 2007/0059625 | A1 | 3/2007 | Yamamoto et al. | |
| 2007/0122729 | A1 | 5/2007 | Katoh et al. | |
| 2007/0148568 | A1 | 6/2007 | Kadota et al. | |
| 2007/0166635 | A1 | 7/2007 | Yamamoto et al. | |
| 2007/0190442 | A1 | 8/2007 | Nakamura et al. | |
| 2007/0190443 | A1 | 8/2007 | Hagi et al. | |
| 2007/0207399 | A1 | 9/2007 | Kadota et al. | |
| 2007/0212630 | A1 | 9/2007 | Yasunaga et al. | |
| 2007/0217842 | A1 | 9/2007 | Kato et al. | |
| 2007/0218384 | A1 | 9/2007 | Matsumoto et al. | |
| 2007/0218388 | A1 | 9/2007 | Kurose et al. | |
| 2007/0218390 | A1 | 9/2007 | Nozaki et al. | |
| 2007/0218393 | A1 | 9/2007 | Nozaki et al. | |
| 2007/0238042 | A1 | 10/2007 | Yasunaga et al. | |
| 2008/0032223 | A1 | 2/2008 | Yamamoto et al. | |
| 2008/0038656 | A1 | 2/2008 | Yasunaga et al. | |
| 2008/0063957 | A1 | 3/2008 | Murakami et al. | |
| 2008/0069598 | A1 | 3/2008 | Murakami et al. | |
| 2008/0069605 | A1 | 3/2008 | Fuwa et al. | |
| 2008/0069608 | A1 | 3/2008 | Katoh et al. | |
| 2008/0069617 | A1 | 3/2008 | Matsumoto et al. | |
| 2008/0070149 | A1 | 3/2008 | Kato et al. | |
| 2008/0076054 | A1 | 3/2008 | Nozaki et al. | |
| 2008/0081273 | A1 | 4/2008 | Murakami et al. | |
| 2008/0096119 | A1 | 4/2008 | Yamamoto et al. | |
| 2008/0101823 | A1 | 5/2008 | Katoh et al. | |
| 2008/0124635 | A1 | 5/2008 | Nakamura et al. | |
| 2008/0131797 | A1 | 6/2008 | Ishikawa et al. | |
| 2008/0153018 | A1 | 6/2008 | Mikuriya et al. | |
| 2008/0159777 | A1 | 7/2008 | Fuwa et al. | |
| 2008/0175630 | A1 | 7/2008 | Yasunaga et al. | |
| 2008/0176159 | A1 | 7/2008 | Matsumoto et al. | |
| 2008/0199234 | A1 | 8/2008 | Hagi et al. | |
| 2008/0220357 | A1 | 9/2008 | Nozaki et al. | |
| 2008/0226356 | A1 | 9/2008 | Yasunaga et al. | |
| 2008/0227001 | A1 | 9/2008 | Kadota et al. | |
| 2008/0227009 | A1 | 9/2008 | Fuwa et al. | |
| 2008/0227013 | A1 | 9/2008 | Kadota et al. | |
| 2008/0227016 | A1 | 9/2008 | Nozaki et al. | |
| 2008/0232857 | A1 | 9/2008 | Matsumoto et al. | |
| 2008/0233497 | A1 | 9/2008 | Yamamoto et al. | |
| 2008/0233506 | A1 | 9/2008 | Hagi et al. | |
| 2008/0233510 | A1 | 9/2008 | Nozaki et al. | |
| 2008/0233511 | A1 | 9/2008 | Ishikawa et al. | |
| 2008/0279591 | A1 | 11/2008 | Yasunaga et al. | |
| 2008/0304875 | A1 | 12/2008 | Katoh et al. | |
| 2009/0017391 | A1 | 1/2009 | Yamamoto et al. | |
| 2009/0041511 | A1 | 2/2009 | Fuwa et al. | |
| 2009/0052952 | A1 | 2/2009 | Katoh et al. | |
| 2009/0117481 | A1 | 5/2009 | Yasunaga et al. | |
| 2009/0162772 | A1 | 6/2009 | Fuwa et al. | |
| 2009/0169270 | A1 | 7/2009 | Fuwa et al. | |
| 2009/0186289 | A1 | 7/2009 | Nakamura et al. | |
| 2009/0186291 | A1 | 7/2009 | Mikuriya et al. | |
| 2009/0220879 | A1 | 9/2009 | Matsumoto et al. | |
| 2009/0232542 | A1 | 9/2009 | Yamamoto et al. | |
| 2009/0233199 | A1 | 9/2009 | Nozaki et al. | |
| 2009/0257792 | A1 | 10/2009 | Nakamura et al. | |
| 2009/0297975 | A1 | 12/2009 | Ishikawa et al. | |
| 2009/0297976 | A1 | 12/2009 | Yamamoto et al. | |
| 2010/0009282 | A1 | 1/2010 | Katoh et al. | |
| 2010/0055603 | A1 | 3/2010 | Nozaki et al. | |
| 2010/0150609 | A1 | 6/2010 | Nozaki et al. | |
| 2010/0167196 | A1 | 7/2010 | Hagi et al. | |
| 2010/0239974 | A1 | 9/2010 | Nozaki et al. | |
| 2011/0045401 | A1 | 2/2011 | Murakami et al. | |
| 2011/0053063 | A1 | 3/2011 | Kadota et al. | |
| 2011/0053071 | A1 | 3/2011 | Miki et al. | |
| 2011/0053077 | A1 | 3/2011 | Mikuriya et al. | |
| 2011/0164901 | A1 | 7/2011 | Yamamoto et al. | |
| 2011/0212398 | A1* | 9/2011 | Hayashi et al. | 430/109.3 |
| 2011/0217644 | A1 | 9/2011 | Yamamoto et al. | |
| 2011/0244383 | A1 | 10/2011 | Yamamoto et al. | |
| 2011/0250533 | A1 | 10/2011 | Kadota et al. | |
| 2011/0287356 | A1 | 11/2011 | Fukao et al. | |
| 2011/0294064 | A1 | 12/2011 | Miyaake et al. | |
| 2012/0189951 | A1* | 7/2012 | Sugimoto et al. | 430/108.2 |
| 2012/0219321 | A1 | 8/2012 | Fukao et al. | |
| 2012/0237253 | A1 | 9/2012 | Fukao et al. | |
| 2012/0237267 | A1 | 9/2012 | Fukao et al. | |
| 2012/0251938 | A1 | 10/2012 | Yamamoto et al. | |
| 2012/0264048 | A1 | 10/2012 | Ishikawa et al. | |
| 2012/0328976 | A1 | 12/2012 | Seki et al. | |
| 2013/0029260 | A1 | 1/2013 | Nozaki et al. | |
| 2013/0059247 | A1* | 3/2013 | Sugimoto | G03G 9/0821 430/109.4 |
| 2013/0157184 | A1* | 6/2013 | Sugimoto et al. | 430/105 |
| 2013/0209931 | A1 | 8/2013 | Sato et al. | |

FOREIGN PATENT DOCUMENTS

| | | |
|---|---|---|
| JP | 2004-206081 | 7/2004 |
| JP | 2006-251564 | 9/2006 |
| JP | 2008-116613 | 5/2008 |
| JP | 2010-139643 | 6/2010 |
| JP | 2011-123483 | 6/2011 |
| JP | 2012-008530 | 1/2012 |
| JP | 2012-103680 | 5/2012 |
| JP | 2012-108215 | 6/2012 |

OTHER PUBLICATIONS

Diamond, Arthur S (editor) Handbook of Imaging Materials. Marcel-Dekker, Inc.: New York (2002) pp. 178-182.*

English language machine translation of JP 2010-139643 (Jun. 2010).*

Japanese Publication Submission Paper issued Apr. 7, 2016 Japanese Publication No. 2014-106464 (with English translation).

* cited by examiner

TONER, AND IMAGE FORMING METHOD, PROCESS CARTRIDGE, AND IMAGE FORMING APPARATUS USING THE TONER

CROSS-REFERENCE TO RELATED APPLICATIONS

This patent application is based on and claims priority pursuant to 35 U.S.C. §119 to Japanese Patent Application No. 2012-261127 filed on Nov. 29, 2012 in the Japan Patent Office, the entire disclosure of which is hereby incorporated by reference herein.

TECHNICAL FIELD

This disclosure relates to a toner. In addition, this disclosure also relates to an image forming method, a process cartridge, and an image forming apparatus, which use the toner.

BACKGROUND

In attempting to enhance fixability of toner to recording media, there is a technique in which a combination of a crystalline resin and a non-crystalline resin is used for toner. For example, JP-2008-116613-A discloses a toner which includes a crystalline polyester resin and a non-crystalline polyester resin and in which each of differences between the melting point of the crystalline polyester resin and the temperatures of endothermic peaks of the crystalline resin determined in the first and second temperature rising processes in differential scanning calorimetry (DSC) falls in a specific range. In addition, JP-2006-251564-A discloses a toner which includes a crystalline polyester resin and a non-crystalline resin and in which the endothermic peak temperature and softening pint of the crystalline polyester resin respectively fall in specific ranges while the relation thereof is specified by an inequality and the ratio of the first endothermic energy amount of the crystalline polyester resin determined in the first temperature rising process in differential scanning calorimetry (DSC) to the second endothermic energy amount of the toner determined in the second temperature rising process in the DSC falls in a specific range. However, toner including a crystalline resin and a non-crystalline resin often causes problems in that the toner is adhered to a part of an image forming apparatus under high temperature high humidity conditions; and the low temperature fixability of the crystalline resin is not fully exhibited.

JP-2003-050478-A discloses a toner which includes a crystalline resin and a non-crystalline resin to enhance the low temperature fixability of the toner. It is described in paragraph [0018] and Examples and Comparative Examples of the application that the crystalline resin and the non-crystalline resin are only partially dissolved in each other, and therefore the low temperature fixability of the toner is not fully enhanced.

SUMMARY

The object of this disclosure is to provide a toner which includes a crystalline resin and a non-crystalline resin and which has good low temperature fixability without causing an adhesion problem in that the toner is adhered to a part of an image forming apparatus or toner particles are adhered to each other under high temperature and high humidity conditions.

As an aspect of this disclosure, a toner is provided which includes at least a crystalline resin and a non-crystalline resin and has a thermal property such that when the toner is heated after being firstly heated to 60° C. followed by cooling in differential scanning calorimetry (DSC), the toner has a peak specific to melting of the crystalline resin at a temperature T1, and when the toner is heated after being firstly heated to 80° C. followed by cooling in DSC, the toner does not have a peak specific to melting of the crystalline resin at a temperature not higher than T1.

As another aspect of this disclosure, an image forming method is provided which includes forming an electrostatic latent image on an image bearing member; forming a developer layer including the above-mentioned toner on a developing roller; and developing the electrostatic latent image with the developer layer to form a toner image on the image bearing member.

As another aspect of this disclosure, a process cartridge is provided which includes an image bearing member to bear an electrostatic latent image thereon; and a developing device to develop the electrostatic latent image on the image bearing member with a developer including the above-mentioned toner to form a toner image on the image bearing member. The developing device has a developing roller bearing thereon a layer of the developer to develop the electrostatic latent image with the developer layer; and a developer layer forming member to form the developer layer on the developing roller.

As another aspect of this disclosure, an image forming apparatus is provided which includes an image bearing member to bear an electrostatic latent image thereon; a developing device to develop the electrostatic latent image on the image bearing member with a developer including the above-mentioned toner to form a toner image on the image bearing member; and a transferring device to transfer the toner image onto a recording medium.

The aforementioned and other aspects, features and advantages will become apparent upon consideration of the following description of the preferred embodiments taken in conjunction with the accompanying drawings.

DETAILED DESCRIPTION

Figure 1:
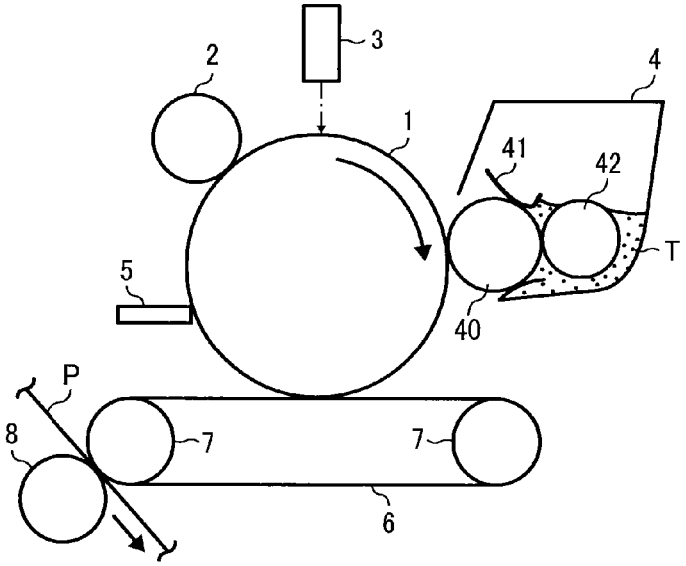
FIG. 1 is a schematic view illustrating an example of an image forming apparatus according to an embodiment.

Initially, the toner of this disclosure will be described.

In a one-component developing device using a regulating blade (a toner layer forming member) to form a toner layer on a developing roller, the temperature of the nip between the regulating blade and the developing roller increases to about 60° C. due to friction therebetween. Therefore, when a crystalline resin and a non-crystalline resin used as binder resins of toner are dissolved in each other at the temperature, a problem (adhesion problem) in that the toner is adhered to the regulating blade is caused.

In addition, from the viewpoint of fixability of toner, it is preferable that a crystalline resin and a non-crystalline resin used as binder resins of toner are perfectly dissolved in each other at a relatively low temperature. As a result of the present inventors' investigation, it is preferable for toner to include a crystalline resin and a non-crystalline resin, which are perfectly dissolved in each other at 80° C.

By using such a toner, the crystalline resin and the non-crystalline resin included in the toner perfectly dissolve in each other, and the crystalline resin does not exhibit the behavior as a crystal. Therefore, the binder resin (i.e., the combination of the crystalline resin and the non-crystalline resin) serves as a non-crystalline resin, thereby enhancing the low temperature fixability of the toner. In addition, since the added amount of the crystalline resin can be reduced, occurrence of problems caused by adding an excessive amount of a crystalline resin can be prevented. Further, by using a combination of a crystalline resin and a non-crystalline resin which does not cause such dissolution at 60° C. and causes the dissolution at a temperature not lower than 80° C. and preferably not lower than 70° C. for toner, occurrence of the adhesion problem can be prevented.

The toner of this disclosure includes at least a crystalline resin and a non-crystalline resin. In this regard, the crystalline resin and the non-crystalline resin in the toner are not dissolved in each other and are present independently of each other before the toner is fixed. In addition, the crystalline resin has a melting point and the non-crystalline resin has a glass transition temperature (or a rubber-state transition temperature).

In an electrophotographic process, the glass transition temperature of a non-crystalline resin included in the toner does not change from a time in which the toner is present in a developing device to a transferring time in which the toner is transferred to a recording medium (such as paper) through a developing process. When the toner on the recording medium is fixed thereto, heat and pressure are applied to the toner, and the crystalline resin and the non-crystalline resin are rapidly dissolved in each other, and the mixture achieves a rubber state, resulting in fixation of the toner. It is preferable for the toner that the crystalline resin and the non-crystalline resin are thus rapidly dissolved perfectly in each other. Namely, it is preferable that the crystalline resin and the non-crystalline resin are dissolved perfectly in each other such that the crystalline resin does not keep the crystalline state.

As a result of the present inventors' investigation, it is found that it is preferable for toner to have a thermal property such that when the toner is subjected to differential scanning calorimetry (DSC) while applying no pressure to the toner, the toner substantially has no endothermic peak after the toner is subjected to one cycle of heating and cooling in the DSC. Specifically, the toner preferably has a thermal property such that when the toner is heated to 60° C. in the first heating process of DSC, the toner still has an endothermic peak (when the toner is subjected to a second heating process), and when the toner is heated to a temperature not lower than 80° C., and preferably not lower than 70° C., in the first heating process of DSC, the toner does not have an endothermic peak. Toner having such a thermal property has good low temperature fixability and does not cause the adhesion problem.

The dissolution temperature and dissolution degree of a crystalline resin and a non-crystalline resin can be adjusted by modifying the following variables.

(1) Glass transition temperature (Tg) or softening point of the non-crystalline resin used;

(2) Melting point of the crystalline resin used;

(3) Choice of monomers used for forming the crystalline resin and the non-crystalline resin used;

(4) Diameter of the crystalline resin dispersed in the toner; and (5) Molecular weight distributions of the crystalline resin and the non-crystalline resin used.

Specifically, the glass transition temperature of the non-crystalline resin and the melting point of the crystalline resin are preferably not lower than 55° C., and more preferably not lower than 60° C. When the glass transition temperature of the non-crystalline resin is lower than 55° C., the crystalline resin and the non-crystalline resin start to dissolve in each other at a relatively low temperature, and perfectly dissolve in each other at 60° C.

The crystalline resin and the non-crystalline resin are preferably resins of the same kind. For example, when a crystalline polyester resin is used as a crystalline resin, a polyester resin is preferably used as a non-crystalline resin. By using such resins, the resins can be satisfactorily dissolved in each other.

When the crystalline resin dispersed in the toner has too large a particle diameter, it becomes hard for the crystalline resin to perfectly dissolve in the non-crystalline resin even when the toner is heated to a high temperature not lower than 70° C., thereby making it impossible for the crystalline resin to fulfill the function thereof. Therefore, the average particle diameter of the crystalline resin dispersed in the toner is preferably not greater than 0.9 μm, and more preferably not greater than 0.5 μm. The particle diameter of the crystalline resin dispersed in the toner can be determined by a method in which the cross-section of the toner is observed with a transmission electron microscope (TEM), and the cross-sectional image is analyzed using an image analyzer. The average particle diameter is determined by measuring the diameters of long sides of particles of the crystalline resin in the toner and then calculating the number average particle diameter.

In order to decrease the particle diameter of a crystalline resin dispersed in the toner, for example, a dispersion which is prepared by dispersing the crystalline resin in an organic solvent solution of a non-crystalline resin (non-crystalline resin B) so that the crystalline resin has a small particle diameter is preferably used. By dissolving such a non-crystalline resin B in the dispersion medium when the crystalline resin is dispersed, a larger shearing force can be applied to the crystalline resin, and thereby a crystalline resin dispersion having a desired particle diameter can be prepared. In this regard, the non-crystalline resin B may be the same as or different from the non-crystalline resin used for the toner.

When the crystalline resin and the non-crystalline resin included in the toner include a large amount of low molecular weight components, the resins are partially dissolved in each other even at a relatively low temperature. Therefore, even when the crystalline resin has a melting point of not lower than 60° C., there is a case where the endothermic peak of the toner specific to the crystalline resin reduces (lowers) or disappears in the second heating process of DSC after the toner is heated to 60° C. in the first heating process of DSC. In order to reduce the amount of low molecular weight components included in a resin, conventional methods such as a method which is disclosed in JP-2001-117271-A and in which the resin is washed with an alcohol can be used.

As mentioned above, it is preferable for the toner that the melting point of the crystalline resin included in the toner ranges from 60 to 80° C.; the particle diameter of the crystalline resin dispersed in the toner is controlled so as to be small; and the amounts of low molecular weight components included in the crystalline resin and the non-crystalline resin are controlled so as to be small. However, all the conditions are not necessarily fulfilled, and by adjusting the conditions while balancing the conditions, the toner of this disclosure can be provided.

Non-crystalline polyester resins are preferably used as the non-crystalline resin of the toner of this disclosure. Polycondensation products of a polyol (1) and a polycarboxylic acid (2) can be used for the non-crystalline polyester resins. In this regard, such non-crystalline polyester resins can be used alone or in combination.

Specific examples of such a polyol (1) include, but are not limited thereto, alkylene glycols (e.g., ethylene glycol, 1,2-propylene glycol, 1,3-propylene glycol, 1,4-butanediol, and 1,6-hexanediol); alkylene ether glycols (e.g., diethylene glycol, triethylene glycol, dipropylene glycol, polyethylene glycol, polypropylene glycol, and polytetramethylene ether glycol); alicyclic diols (e.g., 1,4-cyclohexane dimethanol, and hydrogenated bisphenol A); bisphenols (e.g., bisphenol A, bisphenol F, bisphenol S, and 4,4'-dihydroxybiphenyl compounds (e.g., 3,3'-difluoro-4,4'-dihydroxybiphenyl); bis(hydroxyphenyl)alkanes such as bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (i.e., tetrafluorobisphenol A), and 2,2-bis(3-hydroxyphenyl)-1,1,1,3,3,3-hexafluoropropane; bis(4-hydroxyphenyl)ethers (e.g., bis(3-fluoro-4-hydroxyphenyl)ether; alkylene oxide (e.g., ethylene oxide, propylene oxide, and butylene oxide) adducts of the above-mentioned alicyclic diols; and alkylene oxide (e.g., ethylene oxide, propylene oxide, and butylene oxide) adducts of the above-mentioned bisphenols. These compounds can be used alone or in combination.

Among these polyols, alkylene glycols having from 2 to 12 carbon atoms, and alkylene oxide adducts of bisphenols are preferable, and alkylene oxide adducts of bisphenols and combinations of an alkylene oxide adduct of bisphenol and an alkylene glycol having from 2 to 12 carbon atoms are more preferable.

In addition, aliphatic polyalcohols having three or more hydroxyl groups (e.g., glycerin, trimethylol ethane, trimethylol propane, pentaerythritol, and sorbitol); polyphenols having three or more hydroxyl groups (e.g., trisphenol PA, phenol novolac, and cresol novolac); and alkylene oxide adducts of the above-mentioned polyphenols having three or more hydroxyl groups can be used as the polyol (1).

These polyol compounds can be used alone or in combination.

Specific examples of the polycarboxylic acid (2) include, but are not limited thereto, alkylene dicarboxylic acids (e.g., succinic acid, adipic acid, and sebacic acid); alkenylene dicarboxylic acids (e.g., maleic acid, and fumaric acid); aromatic dicarboxylic acids (e.g., phthalic acid, isophthalic acid, terephthalic acid, naphthalene dicarboxylic acids, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and hexafluoroisopropylidenediphthalic anhydride.

Among these dicarboxylic acids, alkenylene dicarboxylic acids having from 4 to 20 carbon atoms, and aromatic dicarboxylic acids having from 8 to 20 carbon atoms are preferably used.

Specific examples of the polycarboxylic acid (2) having three or more carboxyl groups include aromatic polycarboxylic acids having from 9 to 20 carbon atoms (e.g., trimellitic acid, and pyromellitic acid), but are not limited thereto.

These polycarboxylic acids can be used alone or in combination. When a polycarboxylic acid (2) is reacted with a polyol (1), anhydrides or lower alkyl esters (e.g., methyl esters, ethyl esters, or isopropyl esters) of the polycarboxylic acids mentioned above can also be used as the polycarboxylic acid.

The ratio between the polyol (1) and the polycarboxylic acid (2) (i.e., the equivalent ratio [OH]/[COOH] of the hydroxyl group [OH] of the polyol to the carboxyl group [COOH] of the polycarboxylic acid) is generally from 2/1 to 1/1, preferably from 1.5/1 to 1/1, and more preferably from 1.3/1 to 1.02/1.

The weight average molecular weight (peak molecular weight) of the non-crystalline polyester resin to be included in the toner is generally from 1,000 to 30,000, preferably from 1,500 to 10,000, and more preferably from 2,000 to 8,000. When the molecular weight is less than 1,000, the high temperature preservability of the toner tends to deteriorate, and when the molecular weight is greater than 30,000, the low temperature fixability of the toner tends to deteriorate.

The binder resin of the toner of this disclosure can include a modified polyester resin, which is modified with a urethane group and/or a urea group. The content of such a modified polyester resin in the binder resin is preferably not greater than 20% by weight, more preferably not greater than 15% by weight, and even more preferably not greater than 10% by weight. When the content is greater than 20% by weight, the low temperature fixability of the toner tends to deteriorate. When preparing a toner using such a modified polyester resin, a mixture of the modified polyester resin and another binder resin can be used as the binder resin. However, from the viewpoint of productivity of toner, it is preferable to use a method including mixing a low molecular weight modified polyester resin (hereinafter sometimes referred to as a prepolymer (A)) having an isocyanate group at the end thereof and an amine, which is reactive with the prepolymer, with another binder resin to prepare a toner component liquid; granulating the toner component liquid; and subjecting the prepolymer (A) to a polymer chain growth reaction and/or a crosslinking reaction in or after the granulating process to prepare a modified polyester resin, which is modified with a urethane group and/or a urea group, and to prepare toner particles including the modified polyester resin as a binder resin. By using this method, it becomes possible to include a modified polyester resin having a relatively large molecular weight in the toner, thereby making it possible to adjust the viscoelasticity of the toner.

Such a prepolymer (A) can be prepared, for example, by reacting a polyester, which is a polycondensation product prepared by reacting a polyol (1) with a polycarboxylic acid (2) and which has an active hydrogen atom, with a polyisocyanate (3). Specific examples of the group having an active hydrogen atom include hydroxyl groups (alcoholic hydroxyl groups and phenolic hydroxyl groups), amino groups, carboxyl groups, and mercapto groups. Among these groups, alcoholic hydroxyl groups are preferable.

Specific examples of the polyisocyanate group (3) include aliphatic polyisocyanates (e.g., tetramethylene diisocyanate, hexamethylene diisocyanate, and 2,6-diisocyanato methyl caproate); alicyclic polyisocyanates (e.g., isophorone diisocyanate, and cyclohexylmethane diisocyanate); aromatic diisocianates (e.g., tolylene diisocyanate, and diphenylmethane diisocyanate); aromatic aliphatic diisocyanates (e.g., a, a, a', a'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

The ratio between the polyisocyanate (3) and the polyester resin having a hydroxyl group (i.e., the equivalent ratio [NCO]/[OH] of the isocyanate group [NCO] of the polyisocyanate to the hydroxyl group [OH] of the polyester resin) is generally from 5/1 to 1/1, preferably from 4/1 to 1.2/1, and more preferably from 2.5/1 to 1.5/1. When the ratio [NCO]/[OH] is greater than 5, the low temperature fixability of the toner tends to deteriorate. When the ratio [NCO]/[OH] is less than 1, the content of the urea group in the modified polyester resin decreases, thereby often deteriorating the offset resistance of the toner.

The content of the component of the polyisocyanate (3) in the prepolymer having an isocyanate group at the end thereof is generally from 0.5 to 40% by weight, preferably from 1 to 30% by weight, and more preferably from 2 to 20% by weight. When the content is less than 0.5% by weight, the offset resistance of the toner tends to deteriorate. When the content is greater than 40% by weight, the low temperature fixability of the toner tends to deteriorate.

The number of the isocyanate group included in one molecule of the prepolymer (A) is generally not less than 1 in average, preferably from 1.5 to 3, and more preferably from 1.8 to 2.5. When the number is less than 1, the molecular weight of the modified polyester resin after the polymer chain growth reaction and/or the crosslinking reaction decreases, thereby often deteriorating the offset resistance of the toner.

When performing the polymer chain growth reaction and/or the crosslinking reaction, an amine (B) can be used but is not necessarily used. Suitable materials for use as the amine (B) include diamines (B1), polyamines (B2) having three or more amino groups, amino alcohols (B3), amino mercaptans (B4), amino acids (B5), and blocked amines (B6) in which the amines (B1-B5) mentioned above are blocked. These amines can be used alone or in combination.

Specific examples of the diamines (B1) include aromatic diamines (e.g., phenylenediamine, diethyltoluenediamine, 4,4'-diaminodiphenyl methane, tetrafluoro-p-xylylenediamine, and tetrafluoro-p-phenylenediamine); alicyclic diamines (e.g., 4,4'-diamino-3,3'-dimethyldicyclohexyl methane, diaminocyclohexane, and isophoronediamine); aliphatic diamines (e.g., ethylenediamine, tetramethylenediamine, and hexamethylenediamine, dodecafluorohexylenediamine, and tetracosafluorododecylenediamine); etc.

Specific examples of the polyamines (B2) having three or more amino groups include diethylenetriamine, triethylenetetramine, etc. Specific examples of the amino alcohols (B3) include ethanolamine, hydroxyethylaniline, etc. Specific examples of the amino mercaptan (B4) include aminoethyl mercaptan, aminopropyl mercaptan, etc. Specific examples of the amino acids (B5) include aminopropionic acid, aminocaproic acid, etc. Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc.

If desired, a terminator can be used for the polymer chain growth reaction and/or the crosslinking reaction to adjust the molecular weight of the modified polyester resin. Specific examples of such a terminator include monoamines (e.g., diethylamine, dibutylamine, butylamine, and laurylamine); blocked amines in which such amines are blocked with a ketone (e.g., ketimine compounds); etc.

Next, the crystalline resin to be included in the toner of this disclosure will be described.

A crystalline resin is included in the toner to enhance the low temperature fixability of the toner. Similarly to the non-crystalline resin mentioned above, polyester resins are preferably used for the crystalline resin.

Crystalline polyester resins can also be prepared by subjecting a polyol (1) (such as the above-mentioned polyols) and a polycarboxylic acid (2) (such as the above-mentioned polycarboxylic acids) to a polycondensation reaction. In this regard, aliphatic diols are preferably used as the polyol (1). Specific examples thereof include ethylene glycol, 1,2-propylene glycol, 1,3-propylene glycol, 1,4-butane diol, 1,5-pentane diol, 1,6-hexane diol, 1,7-heptane diol, 1,8-octane diol, neopentyl glycol, 1,4-butene diol, etc. Among these diols, 1,4-butane diol, 1,6-hexane diol, and 1,8-octane diol are preferable, and 1,6-hexane diol is more preferable.

Aromatic dicarboxylic acids having 2 to 8 carbon atoms such as phthalic acid, isophthalic acid, and terephthalic acid and aliphatic carboxylic acids are preferably used as the polycarboxylic acid (2). In order to enhance the crystallinity, aliphatic carboxylic acids are preferably used.

Crystalline resins (crystalline polyester resins) can be differentiated from non-crystalline resins by the thermal property. Specifically, crystalline resin have an endothermic peak (like an endothermic peak of a wax) when being subjected to differential scanning calorimetry (DSC). In contrast, non-crystalline resins have no endothermic peak and have a gentle DSC curve because non-crystalline resins cause glass transition.

The toner of this disclosure can includes a colorant. Suitable materials for use as the colorant include known dyes and pigments. Specific examples of such dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PER- MANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

The toner can optionally include a release agent. Specific examples of the release agent include polyolefin waxes (e.g., polyethylene waxes, and polypropylene waxes); long-chain hydrocarbons (e.g., paraffin waxes, Fischer Tropsch waxes, and SAZOL waxes); and waxes having a carbonyl group. Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate, and 1,18-octadecanediol distearate); polyalkanol esters (e.g., tristearyl trimellitate, and distearyl maleate); polyalkanoic acid amides (e.g., ethylenediaminedibehenylamide); polyalkylamides (e.g., trimellitic acid tristearylamide); dialkyl ketones (e.g., distearyl ketone); etc.

The toner can optionally include an external additive to enhance the properties thereof such as fluidity, developing property, and charging property. Specific examples of such an external additive include particulate inorganic materials, which preferably have an average primary particle diameter of from 5 nm to 2 μm, and more preferably from 5 nm to 500 nm. In addition, it is preferable that the specific surface area of such particulate inorganic materials measured by a BET method is from 20 to 500 $m^2/g$. The content of such an external additive is preferably from 0.01 to 5% by weight, and more preferably from 0.01 to 2.0% by weight, based on the total weight of the toner.

Specific examples of such particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, particles of polymers such as polymers prepared by a soap-free emulsion polymerization or a suspension polymerization (e.g., polystyrene, and (meth)acrylic acid ester copolymers), polycondensation polymers such as silicone resins, benzoguanamine resins, and nylon resins, and thermosetting polymers can also be used as external additives.

It is possible to subject such an external additive to a surface treatment to enhance the hydrophobicity thereof. By using such a surface-treated external additive, the resultant toner can have a good combination of fluidity and charging property even under high humidity conditions. Specific examples of the surface treatment agents include silane coupling agents, silane coupling agents having a fluoroalkyl group, silylating agents, organic titanate coupling agents, aluminum coupling agents, silicone oils, modified silicone oils, etc.

In order to prevent occurrence of a problem in that a release agent included in the toner contaminates the surface of a photoreceptor serving as an image bearing member, and thereby an abnormal image such as images in the form of fish is formed or a toner film is formed on the surface of the photoreceptor, it is preferable to use a particulate inorganic material (such as silica) treated with a silicone oil. By using such an external additive, the resultant toner has good cleaning property.

The toner of this disclosure can be prepared, for example, by the following granulating method, but the toner preparation method is not limited thereto.

The granulating method will be described in detail.

The granulating method typically includes preparing an oil phase liquid (i.e., toner component liquid) in which toner components such as binder resins, colorants and release agents are dissolved or dispersed in an organic solvent; dispersing the oil phase liquid in an aqueous medium to prepare a dispersion (emulsion); removing the organic solvent from the dispersion to prepare particles of the toner components; optionally performing a polymer chain growth reaction and/or a crosslinking reaction when the above-mentioned prepolymer is used as a toner component; washing and drying the toner component particles, resulting in formation of toner particles. The thus prepared toner particles are optionally mixed with an external additive to prepare a toner.

Initially, the organic solvent used for preparing the oil phase liquid will be described.

The organic solvent preferably has a boiling point of lower than 100° C. so as to be easily removed in the solvent removing process. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, ester solvents such as methyl acetate and ethyl acetate, aromatic solvents such as toluene and xylene, and halogenated hydrocarbons such as methylene chloride, 1,2-dichloroethane, chloroform and carbon tetrachloride are preferably used.

The binder resin (such as polyester resins) and the colorant may be dissolved or dispersed in an organic solvent at the same time, but it is preferable that each of the binder resin and the colorant is dissolved or dispersed in an organic solvent. In this regard, the organic solvents may be the same as or different from each other. In addition, since solvents which are used for dissolving polyester resins hardly dissolve release agents which can be preferably used for the toner of this disclosure, it is preferable to use such solvents for preparing the oil phase liquid.

The concentration of the solution or dispersion of the binder resin (such as polyester resins), which is used for preparing the oil phase liquid, is preferably from 40 to 80% by weight. When the concentration is too high, the viscosity of the solution or dispersion seriously increases, and therefore the solution or dispersion is not easy to handle. In contrast, when the concentration is too low, the productivity of toner deteriorates, and the amount of solvent to be removed in the solvent removing process becomes large, resulting in deterioration of the productivity and increase of the costs of the toner.

When a modified polyester resin (prepolymer) having an isocyanate group at the end thereof is used in combination with a binder resin (such as polyester resins), the resins may be dissolved or dispersed in a solvent at the same time (to prepare one resin solution or dispersion) or separately dissolved or dispersed in one or more solvents (to prepare plural resin solutions or dispersions). However, since the solubility and viscosity of such a modified polyester resin are typically different from those of a polyester resin, it is preferable to separately dissolve or disperse the modified polyester resin and the polyester resin (i.e., to separately prepare plural resin solutions or dispersions).

The aqueous medium used for the aqueous phase liquid is water or a combination of water and a solvent which can be mixed with water. Specific examples of such a solvent include alcohols (e.g., methanol, isopropanol, and ethylene glycol), dimethylformamide, tetrahydrofuran, cellosolves (e.g., methyl cellosolve), lower ketones (acetone and methyl ethyl ketone), etc. The amount of the aqueous medium used is generally from 50 to 2,000 parts by weight, and preferably from 100 to 1,000 parts by weight, based on 100 parts by weight of the particulate resin material (i.e., toner particles).

When the oil phase liquid is dispersed in the aqueous medium (aqueous phase liquid), an inorganic dispersant or a particulate resin is preferably added to the aqueous medium to stabilize the particles of the oil phase liquid in the aqueous medium and to sharpen the particle diameter distribution of the resultant toner particles.

Specific examples of such an inorganic dispersant include tricalcium phosphate, calcium carbonate, titanium oxide, colloidal silica, hydroxyapatite, etc.

Specific examples of the resin for use as the particulate resin include vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination. Among these resins, vinyl resins, polyurethane resins, epoxy resins, polyester resins, and combinations thereof are preferable because aqueous dispersions of the resins in which fine resin particles are dispersed can be easily prepared.

When dispersing a particulate resin in an aqueous medium, a surfactant can be used if desired. Specific examples of such a surfactant include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives, and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amide derivatives, and polyhydric alcohol derivatives; and ampholytic surfactants such as alanine, dodecyldi(aminoethyl)glycin, di(octylaminoethyle)glycin, and N-alkyl-N,N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkyl(C7-C13) carboxylic acids and their metal salts, perfluoroalkyl(C4-C12)sulfonic acids and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16) ethylphosphates, etc.

Specific examples of cationic surfactants having a fluoroalkyl group include primary, secondary and tertiary aliphatic amines having a fluoroalkyl group, aliphatic quaternary ammonium salts such as perfluoroalkyl(C6-C10) sulfoneamidepropyltrimethylammonium salts, benzalkonium salts, benzetonium chloride, pyridinium salts, imidazolinium salts, etc.

Further, it is preferable to stabilize the emulsion or dispersion of the oil phase liquid using a polymeric protection colloid.

Specific examples of such a protection colloid include polymers and copolymers prepared using one or more monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When a dispersant such as calcium phosphate, which can be dissolved in an acid or an alkali, is used, it is preferable to dissolve the dispersant with hydrochloric acid to remove the dispersant from the toner particles, followed by washing the toner particles. In addition, it is possible to remove such a dispersant by decomposing the dispersant using an enzyme. When a dispersant is used for preparing toner particles, it is possible that the dispersant remains on the toner particles, but it is preferable to remove the dispersant by washing the resultant toner particles to impart good charging property to the toner particles.

The dispersing machine used for dispersing or emulsifying the oil phase liquid in the aqueous phase liquid is not particularly limited, and known dispersing machines such as low speed shear dispersing machines, high speed shear dispersing machines, friction dispersing machines, high pressure jet dispersing machines, and ultrasonic dispersing machines can be used.

When high speed shear dispersing machines are used, the revolution of the rotor is not particularly limited, but the revolution is generally from 1,000 to 30,000 rpm, and preferably from 5,000 to 20,000 rpm. The dispersing temperature is preferably from 0 to 150° C. (under pressure) and preferably from 20 to 80° C.

Next, the method for preparing the oil phase liquid will be described.

Specific examples of the method for preparing the oil phase liquid include a method in which toner components such as a binder resin, a colorant, and other components are added to an organic solvent while agitating the mixture to dissolve or disperse the toner components. However, when a pigment is used as the colorant and/or a release agent or a charge controlling agent, which is hardly soluble in an organic solvent, is used, it is preferable to subject the materials to a pretreatment so that the materials have a relatively small particle size before the materials are added to the organic solvent. One of such pretreatment is to prepare a master batch of pigment. The technique of preparing a master batch of pigment mentioned later can be applied to other materials such as release agents and charge controlling agents.

In addition, a wet master preparation method in which a colorant, a release agent or a charge controlling agent is dispersed in an organic solvent optionally using a dispersant can also be used.

Further, when a material having a melting point lower than the boiling point of an organic solvent is dispersed in the organic solvent, a method in which the mixture of the material and the organic solvent is heated optionally using a dispersant to dissolve the material in the organic solvent, and then the mixture is cooled while agitating the mixture or applying a shearing force thereto so that fine crystals of the material are formed in the organic solvent can also be used.

The dispersions of a colorant, a release agent and a charge controlling agent are added to an organic solvent together with a binder resin (or a binder resin solution or dispersion) to prepare an oil phase liquid. In this case, the mixture may be further subjected to a dispersing treatment using a dispersing machine such as bead mills and disc mills.

Next, the method of dispersing the oil phase liquid in the aqueous medium (aqueous phase liquid) will be described.

The method is not particularly limited, and known dispersing machines such as low speed shear dispersing machines, high speed shear dispersing machines, friction dispersing machines, high pressure jet dispersing machines, and ultrasonic dispersing machines can be used. In order to prepare a dispersion (emulsion) in which particles of the oil phase liquid dispersed therein have a particle diameter of from 2 μm to 20 μm, high speed shear dispersing machines are preferable. When high speed shear dispersing machines are used, the revolution of the rotor is not particularly limited, but the revolution is generally from 1,000 to 30,000 rpm, and preferably from 5,000 to 20,000 rpm. When a batch type dispersing machine is used, the dispersing time is generally from 0.1 to 5 minutes. When the dispersing time is longer than 5 minutes, problems such that particles having an excessively small particle diameter are formed; and particles in an excessively dispersed state form aggregates (large particles) tend to be caused, and therefore it is not preferable. The dispersing temperature is generally from 0 to 40° C., and preferably from 10 to 30° C. When the temperature is higher than 40° C., a problem such that the molecules of the particles are excited, thereby deteriorating the dispersion stability of the dispersant, resulting in formation of aggregates (large particles) tends to be caused, and therefore it is not preferable. In contrast, when the temperature is lower than 0° C., the viscosity of the dispersant seriously increases, and therefore the energy for preparing the dispersion increases while the productivity of toner deteriorates.

The above-mentioned surfactants for use in dispersing a particulate resin in an aqueous medium can also be used for dispersing the oil phase liquid in the aqueous phase liquid. In order to efficiently disperse droplets of the oil phase liquid including a solvent in the aqueous phase liquid, disulfonic acid salts having a relatively high HLB (hydrophile-lipophile balance) are preferably used.

The concentration of a surfactant in the aqueous medium is generally from 1 to 10% by weight, preferably from 2 to 8% by weight, and more preferably from 3 to 7% by weight. When the concentration is higher than 10% by weight, problems such that the droplets of the oil phase liquid have an excessively small particle diameter; and an inverted micelle structure is formed, thereby deteriorating the dispersion stability, resulting in formation of droplets of the oil phase liquid having a large particle diameter are caused, and therefore it is not preferable. In contrast, when the concentration is lower than 1% by weight, it is hard to stably disperse the oil phase liquid, and a problem such that droplets of the oil phase liquid having a large particle diameter are formed is caused.

Next, an optional polymer chain growth reaction and/or a crosslinking reaction is performed to form, as a binder resin of the toner, a polyester resin modified so as to have a urethane group and/or a urea group. When such a reaction is performed, a modified polyester (prepolymer) having an isocyanate group at the end thereof is added optionally together with an amine. In this regard, the isocyanate group is reacted with the added amine or an amine which is formed by a reaction of water with part of the isocyanate group. When an amine is used, the amine may be added to the oil phase liquid before the oil phase liquid is added to the aqueous medium, or added to the aqueous phase liquid. The reaction time depends on the factors such as the structure of the isocyanate group of the prepolymer and the reactivity of the added amine with the prepolymer, but is generally from 1 minute to 40 hours, and preferably from 1 hour to 24 hours. The reaction temperature is generally from 0 to 150° C., and preferably from 20 to 98° C.

After the dispersion (emulsion) in which the oil phase liquid is dispersed in the aqueous phase liquid is prepared optionally performing the polymer chain growth reaction and/or a crosslinking reaction, the organic solvent is removed from the dispersion. In this regard, any known methods such as a method in which the dispersion is gradually heated under normal pressure or reduced pressure to evaporate the organic solvent from the droplets of the oil phase liquid in the dispersion, resulting in removal of the organic solvent can be used. Thus, a dispersion of toner particles is prepared.

Next, the dispersion of toner particles is subjected to washing and drying. Any know methods can be used for the washing and drying treatments.

Specifically, the dispersion of toner particles is initially subjected to a solid/liquid separation treatment using a centrifugal separator or a filter press to obtain a toner cake, and the toner cake is dispersed in ion exchange water with a temperature of from room temperature to 40° C. After the dispersion is subjected to pH adjustment using an acid or an alkali if desired, the dispersion is subjected to a solid/liquid separation treatment. These treatments are repeated plural times to remove impurities and surfactants from the toner particles. Next, the toner cake (i.e., wet toner particles) is dried using a drier such as flash driers, circulation driers, decompression driers, and vibration-flow driers to prepare dry toner particles. In this case, relatively fine toner particles may be removed from the toner particles by centrifugal separation. Alternatively, the dry toner particles may be subjected to classification using a known classifier so that the toner particles have a desired particle diameter distribution.

The thus prepared toner particles can be mixed with an external additive such as charge controlling agents and fluidizers. In this treatment, a mechanical impact can be applied to the mixture powder so that the external additive is fixed to or integrated with the surface of the toner particles and the external additive is not easily released therefrom.

Specific examples of the impact application method include a method in which an impact is applied to the mixture by a blade rotated at a high speed, and a method in which the mixture is fed into a high speed airflow, and then accelerated so that the particles are collided with each other or a collision plate, resulting in application of an impact to the mixture. Specific examples of the impact applicator include ONG MILL (from Hosokawa Micron Corp.), modified I TYPE MILL in which the pressure of air used for pulverizing is reduced (manufactured by Nippon Pneumatic Mfg. Co., Ltd.), HYBRIDIZATION SYSTEM (manufactured by Nara Machinery Co., Ltd.), KRYPTRON SYSTEM (manufactured by Kawasaki Heavy Industries, Ltd.), automatic mortars, etc.

Next, the image forming method, the image forming apparatus, and the process cartridge of this disclosure will be described.

Initially, the image forming apparatus and the process cartridge will be described. The image forming apparatus of this disclosure forms images using the toner of this disclosure. Although the toner of this disclosure can be used as a one component developer or for a two component developer including the toner and a carrier, the toner is preferably used as a one component developer. In addition, the image forming apparatus preferably includes a photoreceptor, and an endless intermediate transfer medium, which receives a toner image from the photoreceptor and transfers the toner image to a recording material. Further, the image forming apparatus preferably includes one or more cleaners for cleaning the surfaces of the photoreceptor and/or the intermediate transfer medium to remove residual toner particles therefrom. The cleaners may or may not use a cleaning blade. Furthermore, the image forming apparatus preferably uses a fixing device using a fixing member such as a roller having a heater therein, and a belt which is heated by a heater. In the regard, it is preferable not to apply an oil to the fixing member. Furthermore, the image forming apparatus can optionally include other devices such as a discharger for discharging the image bearing member after the image transfer process, a recycling device for feeding the toner particles collected by the cleaners to the developing device to reuse the toner particles, and a controller for controlling the operations of the above-mentioned devices of the image forming apparatus.

The process cartridge of this disclosure includes at least a photoreceptor to bear an electrostatic latent image thereon, and a developing device for developing the electrostatic latent image with a developer including the toner of this disclosure to form a toner image on the photoreceptor, and optionally includes other devices such as chargers to charge the photoreceptor, irradiating devices to irradiate the photoreceptor, transferring devices to transfer the toner image onto a recording medium, sheet separating devices to separate the recording medium bearing the toner image from the photoreceptor or an intermediate transfer medium, cleaners to clean the surface of the photoreceptor and/or the intermediate transfer medium, and discharging devices to discharge the photoreceptor. The process cartridge is detachably attachable to an image forming apparatus (such as the image forming apparatus of this disclosure) as a unit using a guide member (such as rails) of the image forming apparatus.

Figure 2:
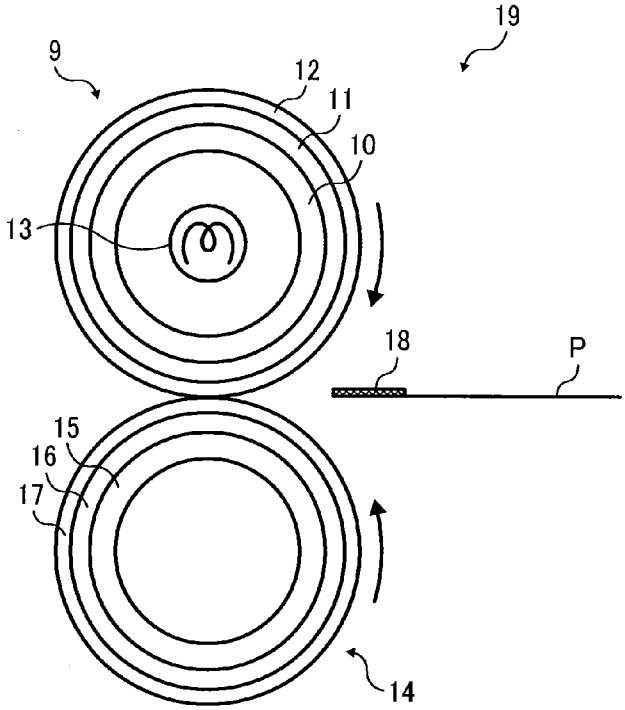
FIG. 2 is a schematic view illustrating a fixing device for use in the image forming apparatus.

FIG. 1 illustrates an example of the image forming apparatus of this disclosure, and FIG. 2 illustrates a fixing device for use in the image forming apparatus.

Referring to FIG. 1, the image forming apparatus includes an image bearing member 1 such as a photoreceptor, and a charger 2, an irradiating device 3, a developing device 4 containing a developer including a toner T, which is the toner of this disclosure, a cleaner 5, an intermediate transfer medium 6, support rollers 7, a transfer roller 8, and a discharger (not shown), which are provided in the vicinity of the image bearing member 1.

This image forming apparatus has a recording medium cassette (not shown) containing recording sheets P serving as a recording medium, and the recording sheets P are fed one by one by a feed roller (not shown). The thus fed recording sheet P is timely fed to a secondary transfer nip between the transfer roller 8 and the intermediate transfer medium 6 by a pair of registration rollers (such as registration rollers 20 illustrated in FIG. 3).

The image forming method of the image forming apparatus is as follows. The charger 2 evenly charges a surface of the image bearing member 1, which is rotated clockwise in FIG. 1, and the irradiating device 3 irradiates the charged image bearing member with laser light modulated based on image data to form an electrostatic latent image on the image bearing member 1. The developing device 4 develops the electrostatic latent image with the toner T of this disclosure (or a developer including the toner) to form a toner image on the image bearing member 1. The toner image on the image bearing member 1 is transferred onto the intermediate transfer medium 6 to which a transfer bias is applied, and the toner image is then transferred onto the recording sheet P at the secondary transfer nip between the transfer roller 8 and the intermediate transfer medium 6. The recording sheet P bearing the toner image thereon is then fed to a fixing device (such as a fixing device 19 illustrated in FIG. 2) to fix the toner image. As illustrated in FIG. 2, the fixing device 19 has a fixing roller 9 heated to a predetermined temperature by a heater 13 set therein, and a pressure roller 14 pressed toward the fixing roller 9 at a predetermined pressure. The recording sheet P bearing a toner image 18 is heated and pressed by the fixing roller 9 and the pressure roller 14, resulting in fixation of the toner image 18 on the recording sheet P. The fixing device 19 will be described later in detail. The recording sheet P bearing the fixed toner image thereon is then discharged from the main body of the image forming apparatus so as to be stacked on a copy tray.

After the toner image is transferred from the image bearing member 1 to the intermediate transfer medium 6, the cleaner 5 removes toner particles remaining on the image bearing member 1, which is rotated, and the discharger discharges residual charges on the image bearing member so that the image bearing member is ready for the charging operation of the next image forming operation.

Next, the devices and members of the image forming apparatus will be described in detail.

The material, shape, configuration and size of the image bearing member 1 are not particularly limited. With respect to the shape, drum shapes, and belt shapes are preferable. Specific examples of the materials for use in the image bearing member include inorganic photoreceptors such as amorphous silicon and selenium, organic photoreceptors such as polysilane and phthalopolymethine, etc. Among these photoreceptors, amorphous silicon and organic photoreceptors are preferably used for the image bearing member 1 because of having a relatively long life.

In order to form an electrostatic latent image on the image bearing member 1, a method in which the image bearing member is charged and then irradiated with light modulated based on image data. In this regard, the charger 2 charging the image bearing member 1 and the irradiating device 3 irradiating the image bearing member serve as an electrostatic latent image forming device.

The charging operation is performed, for example, by the charger 2, which applies a voltage to the image bearing member 1. Specific examples thereof include contact chargers having a roller, brush, film or rubber blade, which is made of a conductive material or a semi-conductive material, and non-contact chargers utilizing corona discharging such as corotrons and scorotrons, but are not limited thereto.

As mentioned above, the shape of the charger is not limited to roller shapes, and brushes such as magnetic brushes and fur brushes can also be used therefor. Specific examples of the magnetic brushes include combinations of a charging member made of a particulate ferrite material such as Zn—Cu ferrites, a non-magnetic electroconductive sleeve supporting the charging member, and a magnet roller located in the sleeve to bear the charging member on the sleeve. Specific examples of the fur brushes include brushes having a shaft made of a metal or a material subjected to an electroconductive treatment, and fibers which are subjected to an electroconductive treatment using carbon, copper sulfide, a metal or a metal oxide and which are held by the shaft.

Among the contact and non-contact chargers, contact chargers are preferably used for the image forming apparatus because of generating a smaller amount of ozone in the charging operation than non-contact chargers.

The irradiation process is performed by irradiating the charged image bearing member with light, which is modulated based on image data, using the irradiating device 3. The irradiating device 3 is not particularly limited as long as the device can irradiate the charged image bearing member with light modulated based on image data. Specific examples thereof include optical systems for use in copiers, rod lens arrays, laser optical systems, liquid shutter optical systems, etc.

The developing process is performed by developing an electrostatic latent image with the toner of this disclosure or a developer including the toner using the developing device 4. The developing device 4 is not particularly limited as long as the device can develop an electrostatic latent image with the toner of this disclosure. Specific examples thereof include developing devices which supply the toner of this disclosure to an electrostatic latent image in a contact or non-contact manner.

The developing device 4 preferably has a developing roller 40 which rotates while being contacted with the image bearing member 1 and which supplies the toner T to an electrostatic latent image on the image bearing member to develop the electrostatic latent image, a toner layer forming member 41 to form a thin layer of the toner T on the surface of the developing roller 40, and a supply roller 42 to supply the toner to the developing roller 40, as illustrated in FIG. 1.

Metal rollers and elastic rollers are preferably used as the developing roller 40. Specific examples of the metal rollers include aluminum rollers, but are not limited thereto. The surface of such metal rollers may be subjected to a blast treatment to have a desired friction coefficient. Specifically, aluminum rollers whose surface is subjected to a blast treatment using glass beads so that the surface has a rough surface such that a toner layer having a desired weight (thickness) can be satisfactorily formed thereon.

Suitable elastic rollers for use as the developing roller 40 include rollers in which an elastic rubber layer is formed on an electroconductive shaft, and an outermost layer made of a material having such a charging property as to have a charge with a polarity opposite to that of the toner is formed on the elastic rubber layer. The elastic rubber layer preferably has a JIS-A hardness of not higher than 60° to prevent occurrence of a problem in that a pressure is concentrated on the nip between the developing roller 40 and the toner layer forming member 41, thereby deteriorating the properties of the toner. The elastic rubber layer preferably has an Arithmetical Mean Deviation of the Profile (Ra) of from 0.3 μm to 2.0 μm so that a proper amount of toner is born by the surface of the developing roller 40. Since a development bias is applied to the developing roller 40 to form an electric field between the developing roller 40 and the image bearing member 1, the elastic rubber layer preferably has an electric resistance of from $10^3$ to $10^{10}\Omega$. The developing roller 40 rotates counterclockwise in FIG. 1 to feed the toner to a position at which the toner layer forming member 41 is opposed to the developing roller 40 and to a position at which the developing roller 40 is opposed to the image bearing member 1.

The toner layer forming member 41 is provided at a position higher in level than the contact point of the supply roller 42 and the developing roller 40. The toner layer forming member 41 is typically made of a metal such as stainless steel (SUS) and phosphor bronze, and a force of from 10 to 40 N/m is applied to a free end of the member so as to be pressed toward the developing roller 40. Therefore, toner particles passing the nip between the toner layer forming member 41 and the developing roller 40 is frictionally charged while forming a layer on the developing roller. In addition, in order to assist frictional charging of the toner, a bias having the same polarity as that of charge of the toner is applied to the toner layer forming member 41 so that the toner has a larger amount of charge.

Specific examples of the material for use in the elastic rubber layer include styrene-butadiene rubbers, acrylonitrile-butadiene rubbers, acrylic rubbers, epichlorohydrin rubbers, urethane rubbers, silicone rubbers, mixtures of two or more of these rubbers, etc., but are not limited thereto. Among these rubbers, epichlorohydrin rubbers, and acrylonitrile-butadiene rubbers are preferably used.

The developing roller 40 is typically prepared by covering an electroconductive shaft (such as stainless steel (SUS)) with an elastic rubber layer.

The transfer process is performed using a transfer roller while charging the image bearing member 1. The transferring device preferably has a primary transfer member (such as transfer roller) to transfer a toner image from the image bearing member 1 to the intermediate transfer medium 6, and a secondary transfer member (such as the transfer roller 8) to transfer a toner image from the intermediate transfer medium to the recording sheet P. It is possible that plural color toners formed on the image bearing member 1 (or plural image bearing members) are transferred to the intermediate transfer medium 6 using one or more primary transfer members to form a combined color toner image on the intermediate transfer medium, and the combined color toner image is then transferred onto the recording sheet P using the secondary transfer member 8.

The intermediate transfer medium 6 is not particularly limited, and any known intermediate media such as intermediate transfer belts can be used.

Each of the primary and secondary transfer members preferably has at least one transfer member to subject a toner image to charging by separation. Specific examples of the transfer member include corona chargers, transfer belts, transfer rollers, pressure rollers, and adhesive transfer rollers, etc.

Plain paper is typically used for the recording sheet P, but the recording sheet is not limited thereto. For example, plastic sheets (such a polyethylene terephthalate (PET) films for use in OHP (overhead projection)) can also be used.

The fixing process is performed by fixing a toner image on the recording sheet P using a fixing device such as the heat fixing device 19. When plural color toner images are overlaid on the recording sheet P, the fixing process may be performed on each toner image or the overlaid plural color toner images.

Any known fixing device can be used for the fixing device of the image forming apparatus, and fixing devices which fix a toner image upon application of heat and pressure are preferably used. Specific examples of the heat/pressure fixing devices include fixing devices using a heat roller serving as a fixing member, and a pressure roller as illustrated in FIG. 2, and fixing devices using a heat roller, a pressure roller, and an endless belt serving as a fixing member and heated by the heat roller. The temperature of the fixing member is preferably from 80 to 200° C.

An example of the heat/pressure fixing devices is illustrated in FIG. 2. The fixing device has a soft roller having an outermost layer made of a fluorine-containing material. Referring to FIG. 2, the heat roller 9 has a structure such that an elastic layer 11 made of a silicone rubber is formed on an aluminum shaft 10, and an outermost layer 12 made of a tetrafluoroethylene-perfluoroalkylvinyl ether copolymer (PFA) is formed on the elastic layer 11 while the heater 13 is provided in the heat roller 9. The pressure roller 14 has a structure such that an elastic layer 16 made of a silicone rubber is formed on an aluminum shaft 15, and an outermost layer 17 made of a PFA is formed on the elastic layer 16. The recording sheet P bearing the toner image 18 is fed to the fixing nip between the heat roller 9 and the pressure roller 14 in such a manner as illustrated in FIG. 2.

A photo fixing device can be used alone or in combination with another fixing device for the image forming apparatus of this disclosure.

The discharging process is performed, for example, by applying a discharge bias to the image bearing member 1 or irradiating the image bearing member with light. Any known dischargers can be used for the discharging process, and discharging lamps are preferably used.

The cleaning process is performed by removing residual toner particles from the surface of the image bearing member 1 (such as photoreceptors) using a cleaner. The cleaner is not particularly limited as long as the cleaner can remove residual toner particles from the surface of the image bearing member. Specific examples of the cleaner include magnetic brush cleaners, electrostatic brush cleaners, magnetic roller cleaners, blade cleaners, brush cleaners, web cleaners, etc., but are not limited thereto.

The toner recycling process is performed by feeding the toner particles collected by the cleaning device 5 to the developing device 4 using a recycling device to reuse the toner particles for development. Specific examples of the recycling device include known powder feeding devices.

The controlling process is performed by controlling the operations of the above-mentioned devices and members using a controller. The controller is not particularly limited, and devices such as sequencers and computers can be used therefor.

By using the toner of this disclosure for the image forming method and apparatus, and the below-mentioned process cartridge of this disclosure, high quality images having good fixability can be produced without causing a problem in that toner particles are damaged (or broken) by the stresses applied to the toner in the developing device.

The image forming apparatus of the present invention can be applied to multi-color image forming apparatuses as well as monochrome image forming apparatuses.

Figure 3:
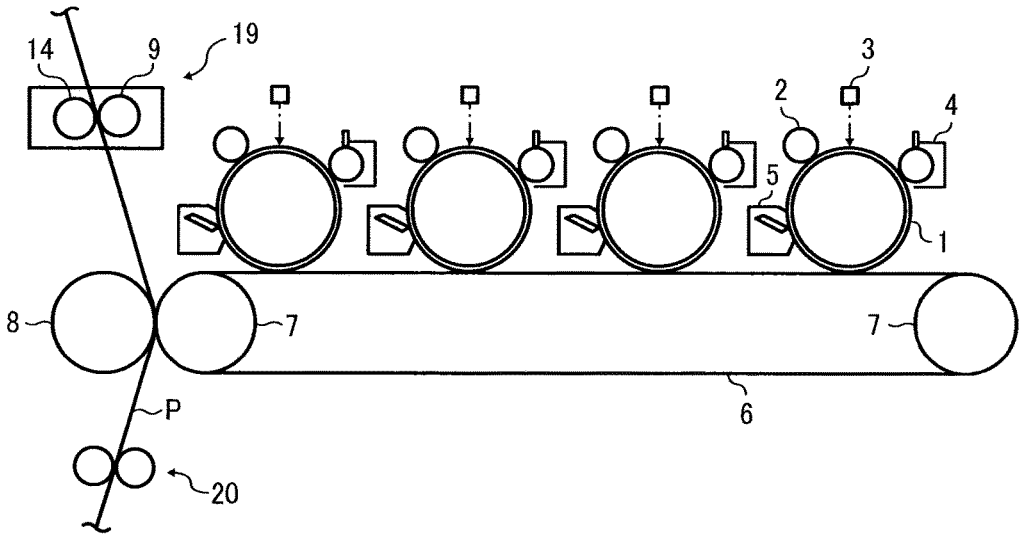
FIG. 3 is a schematic view illustrating another example of the image forming apparatus.

FIG. 3 illustrates a tandem full color image forming apparatus, which is an example of the image forming apparatus of this disclosure.

Referring to FIG. 3, the full color image forming apparatus has four image forming units, each of which includes the image bearing member 1 rotated clockwise, and the charger 2, the irradiating device 3, the developing device 4 and the cleaner 5, which are provided in the vicinity of the image bearing member. In addition, the image forming apparatus includes the intermediate transfer medium 6, which are supported by the support rollers 7, and the transfer roller 8, wherein the intermediate transfer medium, and the transfer roller serve as a transferring device. The image forming apparatus further includes a sheet cassette (not shown) for containing plural recording sheets P, a feeding roller for feeding the recording sheet P, and a pair of registration rollers 20 for timely feeding the recording sheet P to the secondary transfer nip formed by the transfer roller 8 and the intermediate transfer medium 6. Furthermore, the image forming apparatus has the fixing device 19 having the heat roller 9 and the pressure roller 14.

Next, the full color image forming method of the image forming apparatus illustrated in FIG. 3 will be described.

Referring to FIG. 3, in each image forming unit, the charger 2 charges the image bearing member 1, which is clockwise rotated, and the irradiating device 3 irradiates the charged image bearing member with laser light modulated based on image data to form an electrostatic latent image on the image bearing member. The developing device 4 develops the electrostatic latent image with a developer including a color toner (i.e., yellow, magenta, cyan or black toner). Thus, four different color toner images are formed on the image bearing members 1, and the toner images are transferred one by one onto the intermediate transfer medium 6, resulting in formation of a combined color toner image on the intermediate transfer medium. The combined color toner image is transferred onto the recording sheet P at the secondary transfer nip, and the recording sheet bearing the combined color toner image is fed to the fixing device 19, resulting in fixation of the combined color toner image on the recording sheet. Thus, a full color image is formed.

Figure 4:
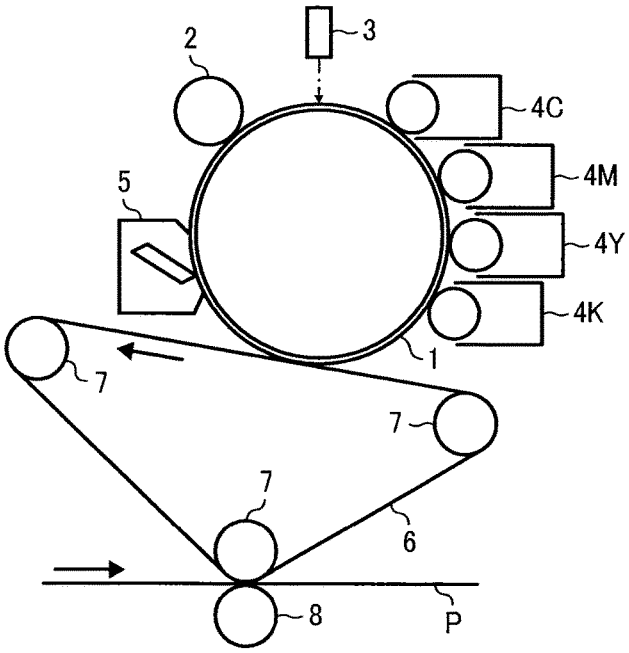
FIG. 4 is a schematic view illustrating yet another example of the image forming apparatus.

FIG. 4 illustrates another full color image forming apparatus (revolver type full color image forming apparatus), which is another example of the image forming apparatus of this disclosure.

This image forming apparatus has one image bearing member 1, the charger 2, the irradiating device 3, four developing devices 4C, 4M, 4Y and 4K, the intermediate transfer medium 6, and the cleaner 5. By switching the developing devices, cyan, magenta, yellow and black color toner images are sequentially formed on the image bearing member 1. The color toner images are then transferred one by one onto the intermediate transfer medium 6 rotated and supported by the support rollers 7, resulting in formation of a combined color toner image on the intermediate transfer medium. The thus formed combined color toner image is then transferred onto the recording sheet P at the secondary transfer nip formed by the transfer roller 8 and the intermediate transfer medium 6, followed by fixation of the toner image on the recording sheet P at a fixing device (not shown in FIG. 4), resulting in formation of a full color image.

After transferring a first color toner image, the surface of the image bearing member 1 is cleaned by a blade of the cleaner 5, followed by a discharging process in which residual charges on the image bearing member are removed therefrom. The thus discharged image bearing member 1 is then charged by the charger 2 to perform a second color toner image forming operation. The cleaner is not limited to a blade, and a fur brush or the like can also be used therefor.

Since the above-mentioned toner of this disclosure is used for the color toners, high quality images can be produced by the image forming method and apparatus of this disclosure.

Next, the process cartridge of this disclosure will be described. The process cartridge of this disclosure includes at least an image bearing member for bearing an electrostatic latent image thereon, and a developing device for developing the electrostatic latent image with a developer including the toner of this disclosure to form a toner image on the image bearing member, and optionally includes other devices such as chargers, irradiating devices, transferring devices, cleaners, and discharging devices. The process cartridge is detachably attachable to an image forming apparatus as a unit.

The developing device includes at least a developer containing portion for containing the toner of this disclosure or a developer including the toner of this disclosure, and a developer bearing member for bearing the toner or developer thereon to feed the toner or developer to the developing area in which the developer bearing member faces the image bearing member. The developing device optionally includes a toner layer forming member for forming a toner layer on the developer bearing member. The process cartridge of this disclosure is detachably attachable to image forming apparatuses such as electrophotographic image forming apparatuses (e.g., copiers, facsimiles and printers). It is preferable to detachably attach the process cartridge to the image forming apparatus of this disclosure.

Figure 5:
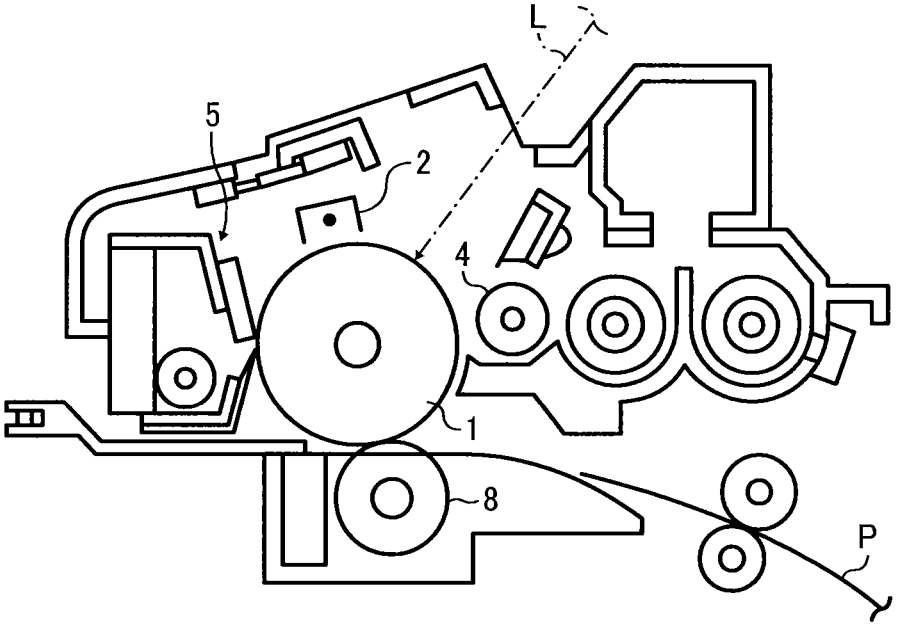
FIG. 5 is a schematic view illustrating an example of a process cartridge according to an embodiment.

FIG. 5 illustrates an example of the process cartridge of this disclosure.

Referring to FIG. 5, the process cartridge has the image bearing member 1, the charger 2, the developing device 4 bearing the developer bearing member, the transfer roller 8, and the cleaner 5. The process cartridge can optionally have other devices. In FIG. 5, reference character L and P respectively denote light emitted by an irradiating device to form an electrostatic latent image on the image bearing member 1, and the recording sheet. Since the configuration and operation of the image bearing member 1, the charger 2, the developing device 4, the transfer roller 8, and the cleaner 5 of the process cartridge are similar to those mentioned above for use in the image forming apparatus of this disclosure, description of the devices is omitted here.

The image forming process of the process cartridge is as follows. After the charger 2 charges a surface of the image bearing member 1, which is rotated clockwise in FIG. 5, the charged image bearing member 1 is irradiated with light L emitted by an irradiating device based on image data to form an electrostatic latent image thereon. The developing device 4 develops the electrostatic latent image with the toner of this disclosure or a developer including the toner to from a toner image on the surface of the image bearing member 1. The toner image is then transferred onto the recording sheet P by the transfer roller 8. The recording sheet bearing the toner image thereon is fed to a fixing device of the image forming apparatus to be subjected to a fixing process, resulting in formation of a fixed image. After the toner image is transferred onto the recording sheet P, the surface of the image bearing member 1 is cleaned by the cleaner 5, and then subjected to a discharging process so that the image bearing member 1 is ready for the next image forming operation.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Initially, methods for measuring the properties of the toners prepared below and the materials used for preparing the toners will be described.

1. Molecular Weight

The molecular weight of a polyester resin or a vinyl resin used for preparing a toner is determined by a gel permeation chromatographic (GPC) method. The measuring conditions are as follows.

(1) Instrument used: HLC-8220GPC (from Tosoh Corp.)
(2) Column used: TSKgel SuperHZM-M×3
(3) Measuring temperature: 40° C.
(4) Solvent used: tetrahydrofuran (THF)
(5) Flow rate: 0.35 ml/min
(6) Amount of sample: 0.01 ml of a sample dispersion at a concentration of from 0.05 to 0.6% by weight is injected.

By using the molecular weight distribution curve and a molecular weight calibration curve prepared by using ten monodisperse polystyrenes, the weight average molecular weight of a resin is determined. The molecular weights of the monodisperse polystyrenes are $5.8\times10^2$, $1.085\times10^4$, $5.95\times10^4$, $3.2\times10^5$, $2.56\times10^6$, $2.93\times10^3$, $2.85\times10^4$, $1.48\times10^5$, $8.417\times10^5$, and $7.5\times10^6$.

2. Endothermic Energy Amount, and Endothermic Peak Temperature

The endothermic energy amount and endothermic peak temperature of a resin or a toner is determined by a differential scanning calorimeter (e.g., DSC-6220R from Seiko Instrument Inc.). Initially, the sample (resin or toner) is heated from 30° C. to 150° C. at a temperature rising speed of 10° C./min to obtain first scan data of the sample, and the sample is allowed to settle for 2 minutes at 150° C. (this operation is referred to as STEP 1). Next, the sample is cooled to 0° C. at a temperature falling speed of 10° C./min, and the sample is allowed to settle at 0° C. for 2 minutes (this operation is referred to as STEP 2). Further, the sample is heated again from 0° C. to 150° C. at a temperature rising speed of 10° C./min to obtain second scan data of the sample (this operation is referred to as STEP 3).

When the maximum temperature in the STEP 1 is 60, 70 or 80° C. to determine the thermal property of the toner, the sample is heated at the maximum temperature for 60 minutes.

The endothermic peak temperature T1 is determined as the temperature at the top of the endothermic peak. The endothermic peak temperature of a release agent or a crystalline resin can be determined by the method.

The endothermic energy amount (in units of mJ) can be determined by calculating the area of a portion of the peak surrounded by the base line and the peak.

Figure 7:
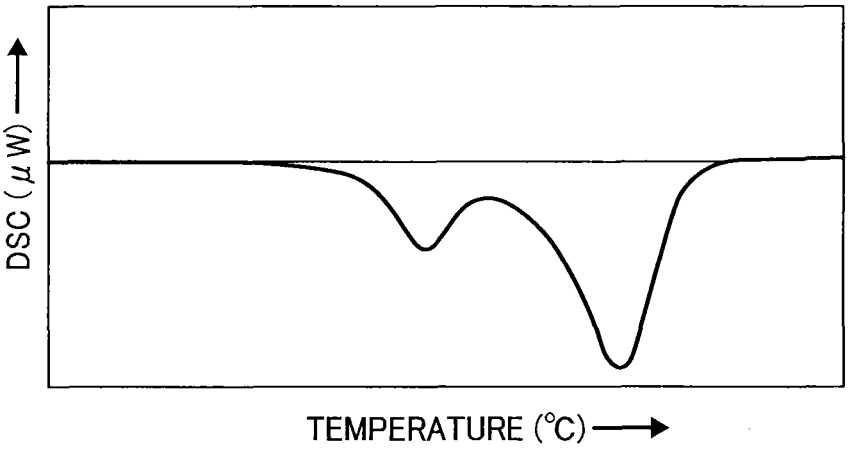
FIG. 7 illustrates a DSC curve in which the endothermic peaks of a crystalline resin and a release agent or the like overlap with each other.
Figure 8:
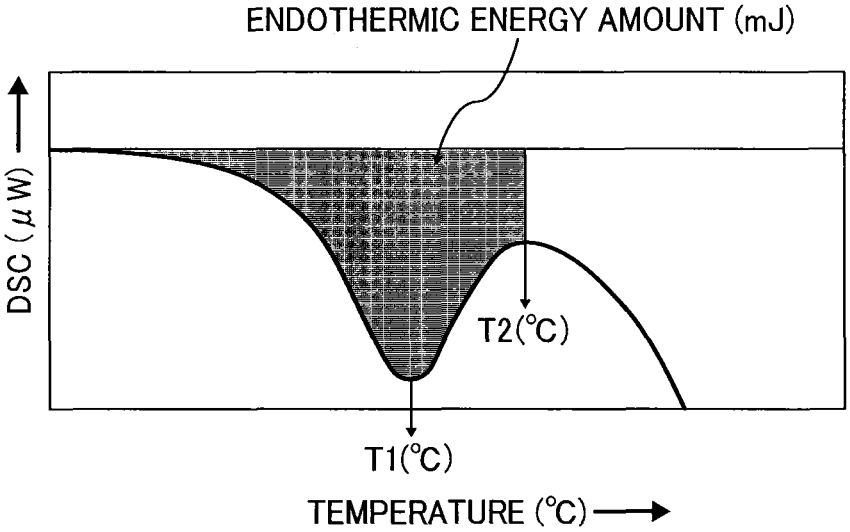
FIG. 8 is an enlarged view of the DSC curve illustrated in FIG. 7 for use in describing the method for determining the endothermic energy amount of the crystalline resin from the DSC curve.

In a case where the endothermic peaks of a crystalline resin and a release agent overlap each other as illustrated in FIG. 7, the area of a portion of the endothermic peak surrounded by the base line, the peak, and the vertical line connecting the top of the peak at T2 and the base line is calculated as illustrated in FIG. 8, which is an enlarged view of FIG. 7.

It is defined in this application that when the endothermic energy amount of a sample is not less than 1 mJ, the sample has a clear endothermic peak.

3. TgA of Resin

The Tg A (i.e., rubber state transition temperature) of a resin is measured by the method in which 1.0 g of a sample is set to a die of the flow tester (CFT-500 from Shimadzu Corp.) and subjected to a flow test under the following conditions:

Size of die used: diameter of 0.5 mm and height of 1.0 mm
Temperature rising speed: 3.0° C./min
Preheating time: 180 seconds
Load: 30 kg
Measuring temperature: 40 to 140° C.

The TgA is defined as the temperature at which the sample starts to deform (i.e., the sample starts to achieve a rubber state). Specifically, the TgA is the temperature at which an extension of a linear portion (line A) of the flow test curve, which represents that the sample is not yet deformed even when receiving the pressure (load), crosses an extension of another linear portion (line B) of the flow test curve, which represents that the sample is pressed while being deformed and achieving a rubber state.

4. Diameter (Median Diameter) of Resin Particles in Crystalline Resin Dispersion The median diameter of resin particles in a crystalline resin dispersion is measured with an instrument LA-920 from Horiba, ltd., followed by analysis using an application (Ver. 3.32 for LA-920). The procedure is as follows. Specifically, initially the background is measured with the instrument using the solvent (ethyl acetate) used for preparing the crystalline resin dispersion, followed by adjustment of the optical axis. Next, a crystalline resin dispersion is dropped in an amount such that the transmission of the liquid in the instrument falls in a range of from 80 to 90% and the average particle diameter of resin particles in the crystalline resin dispersion is measured. The measurement and analysis conditions are as follows:

Number of data acquisition: 15
Relative refraction index: 1.20
Circulation: 5
Strength of ultrasonic wave: 7
Ultrasonic exposure time: 3 minutes The median particle diameter (D50) of resin particles in the crystalline resin dispersion is determined based on the thus obtained particle diameter distribution data on volume basis.

In addition, the content of large resin particles having a particle diameter of not less than 1 μm is also determined based on the particle diameter distribution data.

5. Diameter of Crystalline Resin Dispersed in Toner

An epoxy resin, which is curable in 30 minutes, is dropped on a stub, and allowed to settle for 30 minutes. Particles of a toner are scattered on the epoxy resin, and the epoxy resin bearing the toner particles is allowed to settle for not less than 24 hours. The epoxy resin is cut with an ultramicrotome (from DiATOME) to prepare cross sections of toner particles, and the cross sections are dyed with ruthenium tetroxide. The cross sections are observed with a scanning transmission electron microscope (STEM), and the cross-sectional image is analyzed using image analyze type particle diameter distribution software (MAC-VIEW from Mountech Co., ltd. In this analysis, the diameters of the longer sides of the crystalline resin dispersed in 20 or more toner particles, whose longer side diameter falls in a range of the volume-average particle diameter (Dv) of the toner ±1 μm, are measured to determine the number average particle diameter of the crystalline resin dispersed in the toner particles.

When the toner is not heated to a temperature not lower than the melting point of the crystalline resin or the TgA of the non-crystalline resin included in the toner after the crystalline resin dispersion is prepared, the diameter of the crystalline resin in the toner can be estimated so as to be substantially the same as the diameter of crystalline resin particles of the crystalline resin dispersion.

6. Resistance of Toner to Fixation to Toner Layer Forming Blade (Regulation Blade) Under High Temperature and High Humidity Conditions A toner is contained in a cartridge of an electrophotographic color image forming apparatus (IPSIO SP C220 from Ricoh Co., Ltd.), and 2,000 copies of a white solid image are continuously produced under environmental conditions of 28° C. and 80% RH using the black image forming station of the image forming apparatus. After the running test, a solid image is formed and then the toner layer forming blade (i.e., the toner layer forming member 41) is observed to determine whether the toner is adhered to the blade. The resistance of the toner to fixation to the blade is graded as follows.

○: The toner is not fixed to the blade, and the produced solid image has no abnormal image. (Good)
Δ: The toner is slightly fixed to the blade, but the produced solid image has no abnormal image. (Acceptable)
X: The toner is fixed to the blade, and the produced solid images has a white line image. (Bad)

7. Low Temperature Fixability

Figure 6:
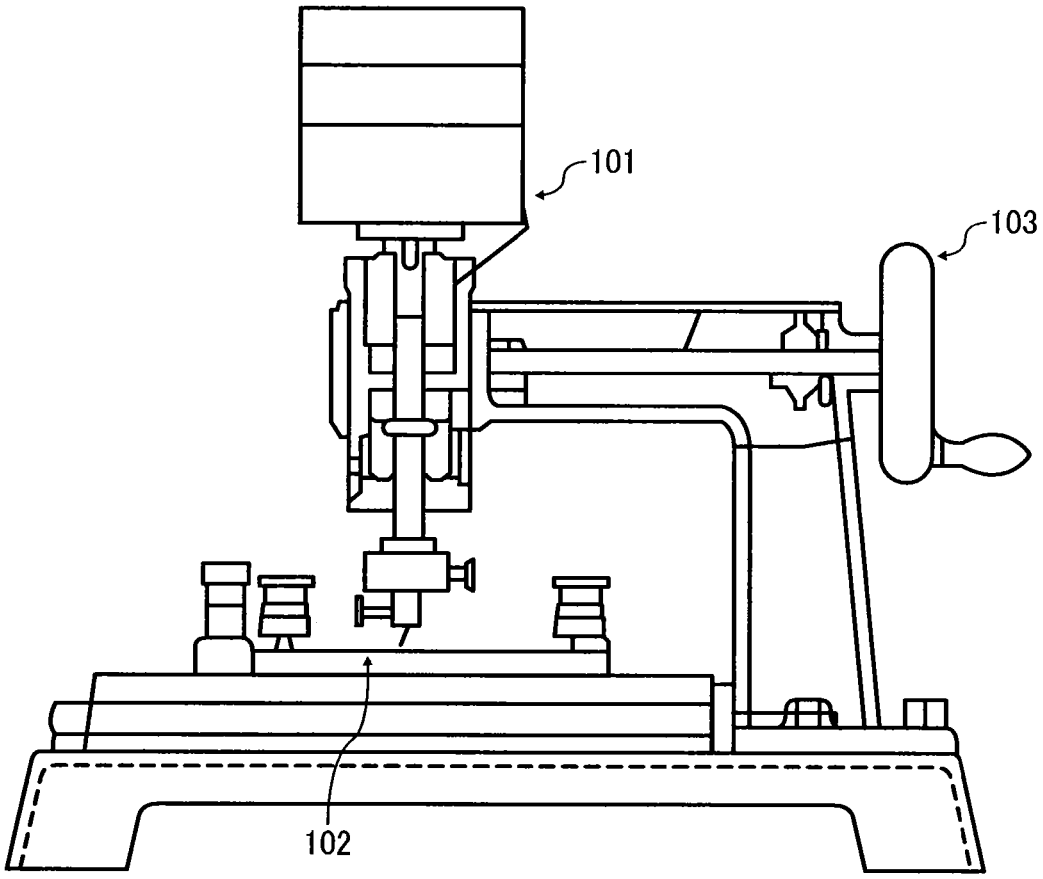
FIG. 6 is a schematic view illustrating a drawing tester used for evaluating the low temperature fixability of toner.

Unfixed toner images having a weight of 1.0±0.1 mg/cm$^2$ are formed on sheets of a paper using a full color printer (IPSIO CX-3000 from Ricoh Co., Ltd.). The paper sheets are fed to a fixing device, which is the fixing device of an image forming apparatus (IPSIO CX-2500 from Ricoh Co., Ltd.) and which is modified so that the temperature of the fixing belt and the speed of the fixing belt can be changed, while changing the fixing temperature from 90° C. to 160° C. Each of the fixed toner images is subjected to a drawing test (scratching test) using a drawing tester illustrated in FIG. 6. In the drawing test using the drawing tester, the paper sheet bearing the fixed toner image is set on a table 102, and a load of 50 g is set on a loading table 101. A handle 103 is rotated five turns in one direction at a speed of from 1 to 2 turns per second to scratch the toner image with a needle. After the toner image is subjected to the drawing test, the toner image is rubbed back and forth three times using a sponge to remove a toner powder, which is released from the toner image in the drawing test. When the white surface of the recording paper is not observed in the toner image subjected to the drawing test, the toner image is considered to be satisfactorily fixed. The low temperature fixability of the toner is graded as follows.

○: The toner is satisfactorily fixed at a fixing temperature of lower than 110° C. (Good)

Δ: The toner is satisfactorily fixed at a fixing temperature of not lower than 110° C. and lower than 140° C. (Acceptable)

X: The toner is satisfactorily fixed at a fixing temperature of not lower than 140° C. (Bad)

8. High Temperature Fixability

Each of the paper sheets bearing the unfixed toner image, which are prepared above in evaluation of the low temperature fixability, is fed to a fixing device of an electrophotographic color image forming apparatus (IPSIO SP C220 from Ricoh Co., Ltd.) while changing the fixing temperature from 140° C. to 190° C. to determine the hot offset temperature at which a hot offset phenomenon is observed. The high temperature fixability of the toner is graded as follows.

○: The hot offset temperature is not lower than 180° C. (Good)

Δ: The hot offset temperature is not lower than 160° C. and lower than 180° C. (Acceptable)

X: The hot offset temperature is lower than 160° C. (Bad)

The materials used for preparing toners are as follows.

1. Non-Crystalline Polyester Resins (1) Polyester Resins 1 and 2

Polyester resins, which have a weight average molecular weight of 16,000 and which include low molecular components in different amounts, are used as polyester resins 1 and 2.

(2) Polyester Resin 3

The following components are contained in a reaction vessel equipped with a condenser, an agitator and a nitrogen feed pipe to perform a polycondensation reaction for 8 hours at 230° C. under normal pressure.

| | |
|---|---|
| Ethylene oxide adduct (2 mole) of bisphenol A | 119 parts |
| Propylene oxide adduct (3 mole) of bisphenol A | 300 parts |
| Terephthalic acid | 90 parts |
| Adipic acid | 200 parts |
| Dibutyl tin oxide | 1 part |

The reaction is further continued for 5 hours under a reduced pressure of from 10 mmHg to 15 mmHg (1,333 Pa to 2,000 Pa). Next, 22 parts of trimellitic anhydride is added thereto and the mixture is reacted for 2 hours at 180° C. under normal pressure. The thus prepared resin is pulverized using a jet pulverizer (IDS from Nippon Pneumatic Mfg. Co., Ltd.) so that the pulverized polyester resin has a volume average particle diameter of 30 μm. Next, 100 parts of the pulverized polyester resin 1 is mixed with 300 parts of ethanol, and the mixture was mixed for 2 hours, followed by filtering and drying. Thus, a polyester resin 3 is prepared. The polyester resin 3 has a number average molecular weight (Mn) of 2,500, a weight average molecular weight (Mw) of 6,500, and a TgA of 55° C., and the weight ratio of components having a molecular weight of not greater than 1,000 is 3.9%.

(3) Polyester Resin 4

A polyester resin having a weight average molecular weight of 9,000 is used as a polyester resin 4.

(4) Polyester Resin 5

A polyester resin having a weight average molecular weight of 18,000 is used as a polyester resin 5.

2. Synthesis of Crystalline Polyester Resin (1) Crystalline Polyester Resin 1

The following components are contained in a reaction vessel equipped with a condenser, an agitator and a nitrogen feed pipe to perform a polycondensation reaction for 8 hours at 200° C. under normal pressure.

| | |
|---|---|
| 1,6-Hexanediol | 500 parts |
| Fumaric acid | 480 parts |
| Dibutyl tin oxide | 2.5 parts |

The reaction is further continued for 2 hours under a reduced pressure of from 10 mmHg to 15 mmHg (1,333 Pa to 2,000 Pa). The thus prepared resin is subjected to the same pulverization treatment and ethanol treatment as those performed for preparing the polyester resin 3. Thus, a crystalline polyester resin 1 is prepared. The crystalline polyester resin 1 has an endothermic peak at 82° C., which is determined by DSC, and the weight ratio of components having a molecular weight of not greater than 1,000 is 1.3%.

(2) Crystalline Polyester Resins 2 and 3

Preparation of Crystalline Polyester Resin 2

The following components are contained in a reaction vessel equipped with a condenser, an agitator and a nitrogen feed pipe to perform a polycondensation reaction for 8 hours at 200° C. under normal pressure.

| | |
|---|---|
| 1,6-Hexanediol | 500 parts |
| Succinic acid | 550 parts |
| Dibutyl tin oxide | 2.5 parts |

The reaction is further continued for 2 hours under a reduced pressure of from 10 mmHg to 15 mmHg (1,333 Pa to 2,000 Pa). Thus, a crystalline polyester resin 2 is prepared. The crystalline polyester resin 2 has an endothermic peak at 68° C., which is determined by DSC, and the weight ratio of components having a molecular weight of not greater than 1,000 is 5.4%.

Preparation of Crystalline Polyester Resin 3

The thus prepared crystalline polyester resin 2 is subjected to the same pulverization treatment and ethanol treatment as those performed for preparing the polyester resin 3. Thus, a crystalline polyester resin 3 is prepared. The crystalline polyester resin 3 has an endothermic peak at 70° C., which is determined by DSC, and the weight ratio of components having a molecular weight of not greater than 1,000 is 1.8%.

(3) Crystalline Polyester Resin 4

The following components are contained in a reaction vessel equipped with a condenser, an agitator and a nitrogen feed pipe to perform a polycondensation reaction for 8 hours at 200° C. under normal pressure.

| | |
|---|---|
| 1,6-Hexanediol | 500 parts |
| Succinic acid | 500 parts |
| Dibutyl tin oxide | 2.5 parts |

The reaction is further continued for 2 hours under a reduced pressure of from 10 mmHg to 15 mmHg (1,333 Pa to 2,000 Pa). The thus prepared resin is subjected to the same pulverization treatment and ethanol treatment as those performed for preparing the polyester resin 3. Thus, a crystalline polyester resin 4 is prepared. The crystalline polyester resin 4 has an endothermic peak at 63° C., which is determined by DSC, and the weight ratio of components having a molecular weight of not greater than 1,000 is 1.5%.

3. Synthesis of Prepolymer

The following components are contained in a reaction vessel equipped with a condenser, an agitator and a nitrogen feed pipe to perform a polycondensation reaction for 8 hours at 230° C. under normal pressure.

| | |
|---|---|
| 1,2-Propylene glycol | 366 parts |
| Terephthalic acid | 566 parts |
| Trimellitic anhydride | 44 parts |
| Tttanium tetrabutoxide | 6 parts |

The reaction is further continued for 5 hours under a reduced pressure of from 10 mmHg to 15 mmHg (1,333 Pa to 2,000 Pa). Thus, an intermediate polyester resin 1 is prepared. The intermediate polyester resin 1 has a number average molecular weight (Mn) of 3,200, a weight average molecular weight (Mw) of 12,000, and a glass transition temperature (Tg) of 55° C.

The following components are contained in a reaction vessel equipped with a condenser, an agitator and a nitrogen feed pipe to perform a reaction for 5 hours at 100° C.

| | |
|---|---|
| Intermediate polyester resin 1 | 420 parts |
| Isophorone diisocyanate | 80 parts |
| Ethyl acetate | 500 parts |

Thus, a prepolymer is prepared. The amount of free isocyanate in the prepolymer is 1.34% by weight.

4. Preparation of Crystalline Polyester Resin Dispersion (1) Crystalline Resin Dispersion 1

The following components are fed into a 5-liter metal container.

| | |
|---|---|
| Crystalline polyester resin 1 | 100 parts |
| Polyester resin 5 | 100 parts |
| Ethyl acetate | 400 parts |

After the mixture is heated to 75° C. to dissolve the resins, the solution is cooled in an ice water bath at a cooling speed of 27° C./min to prepare a resin dispersion.

Next, 500 ml of glass beads having a diameter of 3 mm are added to the resin dispersion to subject the resin dispersion to a dispersing treatment for 36 hours using a batch sand mill (from Kampe Hapio Co., ltd.). Thus, a crystalline resin dispersion 1 is prepared. The median diameter (D50) of the crystalline resin dispersion is 0.35 μm, and the content of large particles having a particle diameter of not less than 1 μm is 16.5% by volume.

(2) Crystalline Resin Dispersion 2

The procedure for preparation and evaluation of the crystalline resin dispersion 1 is repeated except that the following components are used.

| | |
|---|---|
| Crystalline polyester resin 2 | 100 parts |
| Polyester resin 5 | 100 parts |
| Ethyl acetate | 400 parts |

Thus, a crystalline resin dispersion 2 is prepared. The median diameter thereof is 0.37 μm, and the content of large particles having a particle diameter of not less than 1 μm is 17.1% by volume.

(3) Crystalline Resin Dispersion 3

The procedure for preparation and evaluation of the crystalline resin dispersion 2 is repeated except that the dispersing time is changed from 36 hours to 12 hours.

Thus, a crystalline resin dispersion 3 is prepared. The median diameter thereof is 0.71 μm, and the content of large particles having a particle diameter of not less than 1 μm is 39.5% by volume.

(4) Crystalline Resin Dispersion 4

The procedure for preparation and evaluation of the crystalline resin dispersion 1 is repeated except that the following components are used and the dispersing time is changed from 36 hours to 48 hours.

| | |
|---|---|
| Crystalline polyester resin 3 | 100 parts |
| Polyester resin 5 | 100 parts |
| Ethyl acetate | 400 parts |

Thus, a crystalline resin dispersion 4 is prepared. The median diameter thereof is 0.21 μm, and the content of large particles having a particle diameter of not less than 1 μm is 9.6% by volume.

(5) Crystalline Resin Dispersion 5

The procedure for preparation and evaluation of the crystalline resin dispersion 1 is repeated except that the dispersing time is changed from 36 hours to 12 hours.

Thus, a crystalline resin dispersion 5 is prepared. The median diameter thereof is 0.83 μm, and the content of large particles having a particle diameter of not less than 1 μm is 45.2% by volume.

(6) Crystalline Resin Dispersion 6

The procedure for preparation and evaluation of the crystalline resin dispersion 2 is repeated except that the dispersing time is changed from 36 hours to 4 hours.

Thus, a crystalline resin dispersion 6 is prepared. The median diameter thereof is 1.6 μm and the content of large particles having a particle diameter of not less than 1 μm is 57.4% by volume.

(7) Crystalline Resin Dispersion 7

The procedure for preparation and evaluation of the crystalline resin dispersion 4 is repeated except that the dispersing time is changed from 48 hours to 36 hours.

Thus, a crystalline resin dispersion 7 is prepared. The median diameter thereof is 0.28 μm and the content of large particles having a particle diameter of not less than 1 μm is 14.3% by volume.

(8) Crystalline Resin Dispersion 8

The procedure for preparation and evaluation of the crystalline resin dispersion 1 is repeated except that the following components are used.

| | |
|---|---|
| Crystalline polyester resin 4 | 100 parts |
| Polyester resin 5 | 100 parts |
| Ethyl acetate | 400 parts |

Thus, a crystalline resin dispersion 8 is prepared. The median diameter thereof is 0.23 μm and the content of large particles having a particle diameter of not less than 1 μm is 13.0% by volume.

5. Preparation of Master Batch

The following components are mixed using a HENSCHEL MIXER mixer to prepare a mixture in which water penetrates aggregates of the pigment (carbon black).

| | |
|---|---|
| Carbon black (REGAL 400R from Cabot Corp.) | 40 parts |
| Polyester resin 5 serving as binder resin | 60 parts |
| Water | 30 parts |

The mixture is kneaded for 45 minutes using a twin roll mill in which the temperature of the surface of the rollers is set to 130° C., and the kneaded mixture is pulverized by a pulverizer to prepare a master batch 1 having a particle size of 1 mm.

Example 1 (Preparation of Toner)

(1) Preparation of Oil Phase Liquid

The following components are contained in a reaction vessel equipped with an agitator and a thermometer.

| | |
|---|---|
| Polyester resin 2 prepared above | 100 parts |
| Crystalline resin dispersion 1 | 34.5 parts |
| Paraffin wax (melting point of 72° C.) | 8 parts |
| Ethyl acetate | 96 parts |

The mixture is heated to 80° C. while agitated. After being agitated for 5 hours at 80° C., the mixture is cooled to 30° C. over one hour.

Next, 10 parts of the master batch 1 is added thereto, and the mixture is agitated for one hour. Further, the mixture is fed to another contained and subjected to a dispersing treatment using a bead mill (ULTRAVISCOMILL from Aimex Co., Ltd.). The dispersing conditions are as follows.

Liquid feeding speed: 1 kg/hour

Peripheral speed of disc: 6 msec

Dispersion media: zirconia beads with a diameter of 0.5 mm

Filling factor of beads: 80% by volume

Repeat number of dispersing operation: 3 times (3 passes)

Next, 30 parts of the prepolymer is added to the dispersion, and the mixture is agitated for 2 hours using an agitator (THREE-ONE MOTOR). Thus, an oil phase liquid 1 is prepared.

(2) Preparation of Aqueous Phase Liquid

The following components are mixed while agitated.

| | |
|---|---|
| Ion exchange water | 472 parts |
| Aqueous solution of sodium dodecyldiphenyletherdisulfonate (ELEMINOL MON-7 from Sanyo Chemical Industries Ltd., solid content of 50% by weight) | 81 parts |
| 1% Aqueous solution of carboxymethyl cellulose (serving as thickener) | 67 parts |
| Ethyl acetate | 54 parts |

Thus, an aqueous phase liquid 1, which is a milk white liquid, is prepared.

(3) Preparation of Emulsion

After the oil phase liquid 1 in the total amount prepared above is agitated for 1 minute in a vessel using a TK HOMOMIXER mixer (from Primix Corp.), whose rotor is rotated at a revolution of 5,000 rpm, 321 parts of the aqueous phase liquid 1 is added thereto, and the mixture is agitated for 20 minutes using the TK HOMOMIXER mixer (from Primix Corp.), whose rotor is rotated at a revolution of from 8,000 to 13,000 rpm.

Thus, a slurry 1 is prepared.

(4) Solvent Removal

The slurry 1 is fed into a vessel equipped with an agitator and a thermometer, and agitated for 8 hours at 30° C. to remove the organic solvent (i.e., ethyl acetate). Thus, a colored particle dispersion 1 in a slurry state is prepared.

(5) Washing and Drying

1) One hundred (100) parts of the colored particle dispersion 1 is filtered under a reduced pressure to prepare a cake.

2) One hundred (100) parts of ion exchange water is added to the cake and the mixture is agitated for 10 minutes with a TK HOMOMIXER mixer rotated at a revolution of 12,000 rpm, followed by filtering to prepare a cake (a).

3) One hundred (100) parts of ion exchange water is added to the cake (a) and the mixture is agitated for 30 minutes with a TK HOMOMIXER mixer rotated at a revolution of 12,000 rpm while applying supersonic vibration thereto, followed by filtering under a reduced pressure. This washing operation is repeated until the electroconductivity of the resultant slurry becomes not greater than 10 μS/cm.

4) A 10% aqueous solution of hydrochloric acid is added to the slurry so that the mixture has a pH of 4, and the mixture is agitated for 30 minutes by an agitator, followed by filtering to prepare a cake (b).

5) One hundred (100) parts of ion exchange water is added to the cake (b) and the mixture is agitated for 10 minutes by the TK HOMOMIXER mixer rotated at a speed of 12,000 rpm. This operation is repeated until the electroconductivity of the resultant slurry becomes not greater than 10 μS/cm. Thus, a filtered cake 1 is prepared. The residue of the colored particle dispersion 1 is also subjected to the treatments 1) to 5) to prepare multiple batches of the filtered cake 1. All the batches of the filtered cake 1 are mixed.

6) The filtered cake 1 is dried for 48 hours at 45° C. using a circulation dryer, followed by sieving with a screen having openings of 75 μm to prepare a colored particulate resin 1 (i.e., a mother toner (toner particles) 1).

(6) Preparation of Toner

The following components are mixed using a HENSCHEL MIXER mixer.

| | |
|---|---|
| Colored particulate resin 1 prepared above | 50 parts |
| Hydrophobized silica (primary particle diameter of about 30 nm) | 1 part |
| Hydrophobized silica (primary particle diameter of about 10 nm) | 0.5 parts |

Thus, a toner of Example 1 (hereinafter referred to as toner 1) is prepared.

Example 2

The procedure for preparation of the toner 1 in Example 1 is repeated except that the polyester resin 2 and the crystalline resin dispersion 1 used for preparing the oil phase liquid are replaced with the polyester resin 3 and the crystalline resin dispersion 2, respectively.

Thus, a toner of Example 2 (i.e., toner 2) is prepared.

Example 3

The procedure for preparation of the toner 2 in Example 2 is repeated except that the polyester resin 3 is replaced with the polyester resin 4, and the added amount of the crystalline resin dispersion 2 is changed from 34.5 parts to 21.0 parts.

Thus, a toner of Example 3 (i.e., toner 3) is prepared.

Example 4

The procedure for preparation of the toner 3 in Example 3 is repeated except that the crystalline resin dispersion 2 is replaced with the crystalline resin dispersion 3.

Thus, a toner of Example 4 (i.e., toner 4) is prepared.

Example 5

The procedure for preparation of the toner 1 in Example 1 is repeated except that the polyester resin 2 is replaced with the polyester resin 5.

Thus, a toner of Example 5 (i.e., toner 5) is prepared.

Example 6

The procedure for preparation of the toner 1 in Example 1 is repeated except that the polyester resin 2 is replaced with the polyester resin 3, and the added amount of the crystalline resin dispersion 1 is changed from 34.5 parts to 16.5 parts.

Thus, a toner of Example 6 (i.e., toner 6) is prepared.

Example 7

The procedure for preparation of the toner 1 in Example 1 is repeated except that 34.5 parts of the crystalline resin dispersion 1 is replaced with 21.0 parts of the crystalline resin dispersion 4.

Thus, a toner of Example 7 (i.e., toner 7) is prepared.

Comparative Example 1

The procedure for preparation of the toner 7 in Example 7 is repeated except that the crystalline resin dispersion 4 is replaced with the crystalline resin dispersion 5.

Thus, a toner of Comparative Example 1 (i.e., toner 8) is prepared.

Comparative Example 2

The procedure for preparation of the toner 4 in Example 4 is repeated except that the crystalline resin dispersion 3 is replaced with the crystalline resin dispersion 6.

Thus, a toner of Comparative Example 2 (i.e., toner 9) is prepared.

Comparative Example 3

The procedure for preparation of the toner 9 in Comparative Example 2 is repeated except that the polyester resin 4 is replaced with the polyester resin 1 and the crystalline resin dispersion 6 is replaced with the crystalline resin dispersion 7.

Thus, a toner of Comparative Example 3 (i.e., toner 10) is prepared.

Comparative Example 4

The procedure for preparation of the toner 6 in Example 6 is repeated except that 34.5 parts of the crystalline resin dispersion 1 is replaced with 12.4 parts of the crystalline resin dispersion 8.

Thus, a toner of Comparative Example 4 (i.e., toner 11) is prepared.

The evaluation results of the toners 1-11 are shown in Table 1 below.

TABLE 1

| | Non-crystalline resin | Crystalline resin dispersion | Diameter of crystalline resin (μm) | Presence of endothermic peak of crystalline resin | | | Resistance to fixation | Low temp. fixability | High temp. fixability |
|---|---|---|---|---|---|---|---|---|---|
| | | | | Condition (2) | Condition (3) | Condition (4) | | | |
| Ex. 1 | 2 | 1 | 0.42 | Yes | Yes | No | ○ | Δ | ○ |
| Ex. 2 | 3 | 2 | 0.45 | Yes | No | No | ○ | ○ | ○ |
| Ex. 3 | 4 | 2 | 0.46 | Yes | Yes | No | ○ | Δ | ○ |
| Ex. 4 | 4 | 3 | 0.84 | Yes | No | No | ○ | ○ | ○ |
| Ex. 5 | 5 | 1 | 0.41 | Yes | Yes | No | ○ | Δ | ○ |
| Ex. 6 | 3 | 1 | 0.41 | Yes | No | No | ○ | ○ | ○ |
| Ex. 7 | 2 | 4 | 0.22 | Yes | No | No | ○ | ○ | ○ |
| Comp. Ex. 1 | 2 | 5 | 0.98 | Yes | Yes | Yes | Δ | X | X |
| Comp. Ex. 2 | 4 | 6 | 1.87 | Yes | Yes | Yes | Δ | X | X |
| Comp. Ex. 3 | 1 | 7 | 0.33 | No | No | No | X | ○ | X |
| Comp. Ex. 4 | 3 | 8 | 0.26 | No | No | No | X | ○ | X |

In this regard, the conditions (1) to (4) are as follows.

Condition (1): The conditions of DSC by which the endothermic peak temperature of a resin is determined.

Condition (2): The conditions of DSC in which after the sample is heated to 60° C. in STEP 1, the sample is cooled (STEP 2) and then heated again (STEP 3) to determine whether there is an endothermic peak of the crystalline resin.

Condition (3): The conditions of DSC in which after the sample is heated to 70° C. in STEP 1, the sample is cooled (STEP 2) and then heated again (STEP 3) to determine whether there is an endothermic peak of the crystalline resin.

Condition (4): The conditions of DSC in which after the sample is heated to 80° C. in STEP 1, the sample is cooled (STEP 2) and then heated again (STEP 3) to determine whether there is an endothermic peak of the crystalline resin.

Specifically, the details of the conditions (1) to (4) are shown in Table 2 below.

| | STEP 1 | | | | STEP 2 | | | | STEP 3 | | |
|---|---|---|---|---|---|---|---|---|---|---|---|
| Condition | T1 (° C.) | T2 (° C.) | TRS (° C./min) | THT (min) | T1 (° C.) | T2 (° C.) | TRS (° C./min) | THT (min) | T1 (° C.) | T2 (° C.) | TRS (° C./min) |
| (1) | 30 | 150 | 10 | 2 | 150 | 0 | 10 | 2 | 0 | 150 | 10 |
| (2) | 30 | 60 | 10 | 60 | 60 | 0 | 10 | 2 | 0 | 150 | 10 |
| (3) | 30 | 70 | 10 | 60 | 70 | 0 | 10 | 2 | 0 | 150 | 10 |
| (4) | 30 | 80 | 10 | 60 | 80 | 0 | 10 | 2 | 0 | 150 | 10 |

T1: Start temperature
T2: End temperature
TRS: Temperature rising speed
THT: Temperature holding time in which the temperature of the sample is held at T2.

It is clear from Table 1 that the toners of Examples 1 to 7 have good combination of resistance to fixation, low temperature fixability and high temperature fixability, and the toners of Examples 2, 4, 6 and 7, which have no endothermic peak under the condition (3), have better low temperature fixability than the toners of Examples 1, 3 and 5, which have an endothermic peak under the condition (3).

As mentioned above, the toner of this disclosure has good low temperature fixability without causing an adhesion problem in that the toner is adhered to a part (toner layer forming blade) or toner particles are adhered to each other under high temperature high humidity conditions. This is because the toner includes a combination of a crystalline resin and a non-crystalline resin and has a thermal property such that when the toner is heated after being firstly heated to 60° C. followed by cooling in differential scanning calorimetry (DSC), the toner has a clear peak specific to melting of the crystalline resin at a temperature T1, and when the toner is heated after being firstly heated to 80° C. followed by cooling in the DSC, the toner does not have a clear peak specific to melting of the crystalline resin at a temperature not higher than T1.

Additional modifications and variations of the present invention are possible in light of the above teachings. It is therefore to be understood that within the scope of the appended claims the invention may be practiced other than as specifically described herein.

What is claimed is:

1. A toner, comprising:

a crystalline binder resin; and a non-crystalline binder resin, wherein:

a glass transition temperature of all the non-crystalline binder resin is not lower than 55° C.;

the toner has a thermal property such that when the toner is heated to 150° C. for 60 minutes after being firstly heated from 30° C. to 60° C. followed by cooling from 60° C. to 0° C. in differential scanning calorimetry (DSC), the toner has a clear peak specific to melting of the crystalline resin at a temperature T1, and when the toner is heated to 150° C. for 60 minutes after being firstly heated from 30° C. to 80° C. followed by cooling from 80° C. to 0° C. in the differential scanning calorimetry (DSC), no peak can be observed specific to melting of the crystalline resin at a temperature not higher than T1;

the melting point (endothermic peak temperature) of the crystalline binder resin is from 60° C. to 70° C.;

the crystalline binder resin has an average particle diameter of not greater than 0.9 μm as dispersed in the toner; and the non-crystalline binder resin has a weight average molecular weight ranging from 1,000 to 10,000.

2. The toner according to claim 1, wherein the toner has a thermal property such that when the toner is heated to 150° C. for 60 minutes after being firstly heated from 30° C. to 60° C. followed by cooling from 60° C. to 0° C. in differential scanning calorimetry (DSC), the toner has a clear peak specific to melting of the crystalline resin at a temperature T1, and when the toner is heated to 150° C. for 60 minutes after being firstly heated from 30° C. to 70° C. followed by cooling from 70° C. to 0° C. in the differential scanning calorimetry (DSC), the toner has no clear peak specific to melting of the crystalline resin at a temperature not higher than the temperature T1.

3. An image forming method, comprising:

forming an electrostatic latent image on an image bearing member; and developing the electrostatic latent image with a developer including the toner according to claim 1 to form a toner image on the image bearing member.

4. The toner according to claim 1, wherein the average particle diameter of the crystalline binder resin dispersed in the toner ranges from 0.41 to 0.9 μm.

* * * * *